US011766718B2

(12) United States Patent
Woodard

(10) Patent No.: US 11,766,718 B2
(45) Date of Patent: Sep. 26, 2023

(54) COMPOUND FURNACE

(71) Applicant: Desktop Metal, Inc., Burlington, MA (US)

(72) Inventor: Nathan Woodard, Medford, MA (US)

(73) Assignee: Desktop Metal, Inc., Burlington, MA (US)

( * ) Notice: Subject to any disclaimer, the term of this patent is extended or adjusted under 35 U.S.C. 154(b) by 226 days.

(21) Appl. No.: 17/018,334

(22) Filed: Sep. 11, 2020

(65) Prior Publication Data

US 2021/0078075 A1 Mar. 18, 2021

Related U.S. Application Data

(60) Provisional application No. 62/899,358, filed on Sep. 12, 2019.

(51) Int. Cl.
*B22F 3/00* (2021.01)
*B22F 3/10* (2006.01)
(Continued)

(52) U.S. Cl.
CPC ..... *B22F 3/003* (2013.01); *B22F 3/1021* (2013.01); *F27B 5/04* (2013.01); *F27B 5/14* (2013.01); *B22F 3/225* (2013.01); *F27B 2005/064* (2013.01); *F27D 2001/1891* (2013.01); *F27D 2007/023* (2013.01)

(58) Field of Classification Search
CPC .... B22F 2201/20; B22F 3/003; B22F 3/1021; B22F 3/225; F27B 5/14; F27B 5/04; F27B 2005/064; F27D 9/00; F27D 2001/1891; F27D 1/1858; F27D 7/02
USPC ..... 266/249, 250, 251, 252, 256, 255, 280; 432/198, 199, 200, 202, 206
See application file for complete search history.

(56) References Cited

U.S. PATENT DOCUMENTS 3,708,285 A * 1/1973 Scheyer ..... B22F 3/1021 419/36
4,501,717 A * 2/1985 Tsukamoto ..... B22F 3/105 419/57

(Continued)

FOREIGN PATENT DOCUMENTS

EP 1496325 * 1/2005 ..... B22F 3/1021

*Primary Examiner* — Scott R Kastler
*Assistant Examiner* — Michael Aboagye
(74) *Attorney, Agent, or Firm* — Jonathan D. Hall; Oak Law, PLLC

(57) ABSTRACT

A compound sintering furnace with managed contamination for debinding and sintering parts. An inner insulation layer is disposed within an outer insulation layer and has an internal hot face surrounding a work zone. A sealed housing surrounds the inner insulation layer and is composed of a refractory material capable of withstanding a service temperature greater than a debinding temperature and less than a sintering temperature. An outer heater system is configured to heat at least a portion of the sealed housing and externally heat the inner insulation layer to, in conjunction with an inner heater system, heat the work zone to the debinding temperature, and inhibit condensation of a binder within and upon the inner insulation layer during a debinding process. The inner heater system is configured to internally heat the inner insulation and heat the work zone to the sintering temperature.

16 Claims, 15 Drawing Sheets

(51) Int. Cl.

| | |
|---|---|
| ***F27B 5/04*** | (2006.01) |
| ***F27B 5/14*** | (2006.01) |
| *B22F 3/22* | (2006.01) |
| *F27D 7/02* | (2006.01) |
| *F27B 5/06* | (2006.01) |
| *F27D 1/18* | (2006.01) |

(56) References Cited

U.S. PATENT DOCUMENTS

| | | | | | |
|---|---|---|---|---|---|
| 5,048,801 | A * | 9/1991 | Johnson | F27D 7/02 | 266/256 |
| 5,366,679 | A * | 11/1994 | Streicher | C04B 35/63408 | 419/36 |
| 6,163,020 | A * | 12/2000 | Bartusch | H05B 6/705 | 219/746 |
| 10,578,361 | B2 * | 3/2020 | Woodard | B32B 9/007 | |

* cited by examiner

COMPOUND FURNACE

CROSS-REFERENCE TO RELATED APPLICATIONS

This application claims the benefit of priority of U.S. Provisional Application No. 62/899,358, the entirety of which is incorporated by reference into this application.

TECHNICAL FIELD

Various aspects of the present disclosure relate generally to furnaces, and particularly to furnaces configured for debinding and/or sintering operations.

BACKGROUND

Metal injection molding (MIM) is a metalworking process useful in creating a variety of metal objects. A mixture of powdered metal and one or more binders (e.g., a polymer such as polypropylene or wax) may form a "feedstock" capable of being molded, when heated, into the shape of a desired object. The initial molded part, also referred to as a "green part," may then undergo a preliminary debinding process (e.g., chemical debinding or thermal debinding) to remove primary binder while leaving secondary binder intact, followed by a sintering process. During sintering, the part may be heated to vaporize and remove the secondary binder (thermal debinding) and brought to a temperature near the melting point of the powdered metal, which may cause the metal powder to densify into a solid mass, thereby producing the desired metal object. Applicants recognize that extreme temperatures above 1000 C tend to be destructive to many familiar engineering materials even including many metals and ceramics. This is especially the case as temperatures exceed 1250 C. For example even the nickel alloys such as Kanthal® and other high temperature nickel based alloys can be utilized below 1250 C but these materials can rapidly become impractical as temperatures climb above 1250 C. One of the challenges of designing low cost sintering furnaces is that there are very few reasonably priced engineering materials that can survive repeated cycles at sintering temperatures. When faced with narrowing material choices and options, furnace engineers traditionally accept designs that are compromised in various ways including using extreme amounts of power to minimize amount of contaminable insulation while nevertheless suffering significant issues with contamination.

Additive manufacturing, such as three-dimensional (3D) printing, includes a variety of techniques for manufacturing a three-dimensional object via a process of forming successive layers of the object. Three-dimensional printers may in some embodiments utilize a feedstock comparable to that used in MIM, thereby creating a green part without the need for a mold. The green part may then undergo debinding and sintering processes to produce the object.

In addition to MIM based additive manufacturing, there are systems using powder beds and loose powder, optical resin curing, and others. These methods, and others, may involve the use of a furnace to produce the final part or to enhance the properties of the part.

In order to reduce contamination and improve the quality of the part, a vacuum furnace may be used for thermal debinding and/or sintering. Thermal treatment with a vacuum furnace may be useful, for example, to reduce the occurrence of oxidation. While vacuum furnaces may assist in reducing oxidation, these furnaces may be prone to contamination that reduces the quality of the part.

In order to produce higher quality parts, it is beneficial to reduce the amount of contamination present within the furnace especially during sintering. One common source of contamination is from insulation included in the furnace. For example, insulation may retain contaminants, such as moisture, binder released from parts during debinding, and various compounds that offgas from the parts and the structures of the furnace itself during thermal processing. Generally, increased insulation is associated with increased contamination, as these contaminants are often retained by the insulation and released during subsequent thermal processing. Therefore, while thick insulation may reduce the amount of power necessary to maintain desired temperatures within the chamber of the furnace, thick insulation may increase the quantity of contaminants present within the chamber. Some furnaces, such as graphite insulated and molybdenum insulated furnaces, may employ minimal insulation with the aim of reducing contamination. However, the use of minimal insulation may greatly increase the power required (e.g., high power requirements of approximately 20 kW to 100 kW). Moreover, the use of minimal insulation may require the use of water cooling at least to protect the metal chamber surrounding the insulation, which may involve the use of two nested and hermetically-sealed chambers (e.g., steel chambers) with a structure between the two chambers to facilitate the flow of water for heat exchange, adding complexity and cost. Moreover, even when the quantity of insulation is reduced in this or another manner, contamination due to water vapor from the atmosphere (introduced during loading and unloading of parts) and/or condensed binder products, which may become re-volatized during sintering, may still adversely affect part quality.

In some aspects, the presence of contamination within a furnace may lead to contamination of parts or reduced quality in the parts. For example, moisture present within the furnace may increase oxidation of metal powder, or may influence complex chemical reactions throughout the furnace that change and/or influence the carbon content of an alloy in complex and often unpredictable ways during sintering. Some types of insulation, such as ceramic insulation, may be particularly susceptible to contamination, including moisture contamination. However, contamination may occur in various types of insulation, as well as in other components of the furnace.

The apparatus and systems of the current disclosure may address one or more of the problems described above, or address other aspects of the prior art.

SUMMARY

Disclosed is a furnace for high-temperature sintering of metal parts with significantly less contamination—especially during sintering—than previously existing designs available at comparable overall cost. This is accomplished by sealing an inner insulation layer from an outer insulation layer and heating the inner insulation layer sufficiently during debinding of the parts that the temperature of the inner insulation layer causes it to not readily allow condensation of contaminants outgassing from parts during debinding. The contaminants can instead be successfully outgassed from the furnace, rather than building up in the insulation. Heating in the furnace is preferably accomplished using a combination of an inner set of heaters and an outer set of heaters. The outer heaters heat the inner insulation from the outside to ensure the outer portion of the inner insulation is heated sufficiently. The inner heaters provide the majority of the heating necessary to heat a work zone to a sintering temperature to sinter the parts.

Also disclosed is a high temperature seal for the door required to load and unload parts in the above furnace that is capable of both withstanding the very high temperatures required for sintering parts formed from MIM build material and also prevent contaminates from entering the furnace from the ambient environment. Preferably this is accomplished by having an inner seal and an outer seal. The inner seal is capable of withstanding the high temperatures it is exposed to during the sintering process. The outer seal prevents contaminates from reaching the inner seal where they may otherwise enter the furnace at undesirable rates. Preferably inert gas is flowed between the outer seal and the inner seal, where it exits the outer seal, preventing backstream flow of contaminants. The low level of contamination achieved by the above described furnace can therefore be maintained.

In one embodiment, a compound sintering furnace with managed contamination for debinding and sintering parts includes an outer insulation layer and an inner insulation layer disposed within the outer insulation layer and having an internal hot face surrounding a work zone. A sealed housing surrounds the inner insulation layer and is composed of a refractory material capable of withstanding a service temperature, the service temperature being greater than a debinding temperature that is less than 1000 C, and less than a sintering temperature that is greater than 1250 C. An outer heater system is configured to heat at least a portion of the sealed housing and externally heat the inner insulation layer to, in conjunction with an inner heater system, heat the work zone to the debinding temperature, and inhibit condensation of a binder within and upon the inner insulation layer during a debinding process. The inner heater system is configured to internally heat the inner insulation and contribute a majority of heating necessary to heat the work zone to the sintering temperature during a sintering process.

In another embodiment, a low-power high-purity furnace system for high-temperature thermal processing of parts includes an inner furnace including an inner furnace insulation arrangement having an inner hot face surrounding a work zone heated by at least one inner furnace heater. An outer oven that contains the inner furnace and includes a sealable oven housing having an oven door, where the oven door in an open position is operable for loading and unloading parts into and out of the work zone, and where in a closed position the oven door is gaseously sealed to the sealable oven housing. The outer oven includes an outer oven insulation arrangement that supports at least one oven heater therein, the at least one over heater being arranged outside the inner furnace and configured to heat an outside of the inner furnace. The at least one inner furnace heater is configured to controllably heat the work zone, and at least one part therein, to within a range of processing temperatures below a maximum inner furnace temperature. The at least one outer oven heater is configured to controllably heat the outside of the inner furnace to a range of oven temperatures less than the maximum inner furnace temperature.

Both the foregoing general description and the following detailed description are exemplary and explanatory only and are not restrictive of the features, as claimed. As used herein, the terms "comprises," "comprising," "including," "having," or other variations thereof, are intended to cover a non-exclusive inclusion such that a process, method, article, or apparatus that comprises a list of elements does not include only those elements, but may include other elements not expressly listed or inherent to such a process, method, article, or apparatus. Additionally, the term "exemplary" is used herein in the sense of "example," rather than "ideal." It should be noted that all numeric values disclosed or claimed herein (including all disclosed values, limits, and ranges) may have a variation of +/−10% (unless a different variation is specified) from the disclosed numeric value. In this disclosure, unless stated otherwise, relative terms, such as, for example, "about," "substantially," and "approximately" are used to indicate a possible variation of ±10% in the stated value. Moreover, in the claims, values, limits, and/or ranges of various claimed elements and/or features means the stated value, limit, and/or range +/−10%. The terms "object," "part," and "component," as used herein, are intended to encompass any object fabricated using the additive manufacturing techniques described herein.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments. There are many aspects and embodiments described herein. Those of ordinary skill in the art will readily recognize that the features of a particular aspect or embodiment may be used in conjunction with the features of any or all of the other aspects or embodiments described in this disclosure.

DETAILED DESCRIPTION

Figure 1:
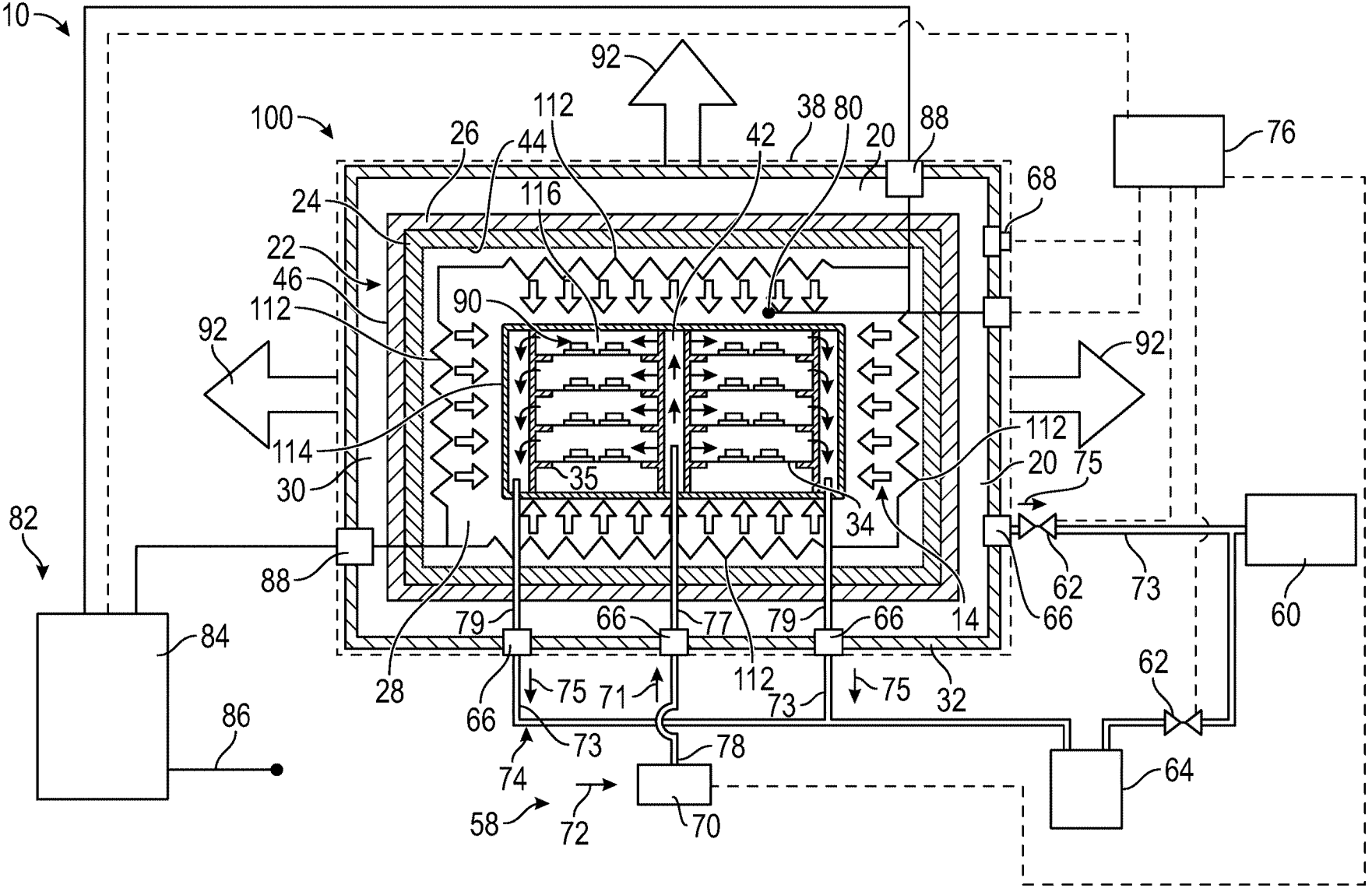
FIG. 1 is a cross-sectional view of a furnace.

Embodiments of the present disclosure include systems and methods to facilitate and improve the efficacy and/or efficiency of sintering printed objects. Reference now will be made in detail to examples of the present disclosure described above and illustrated in the accompanying drawings. Wherever possible, the same reference numbers will be used throughout the drawings to refer to the same or like parts. While exemplary embodiments of a furnace system or furnace may be discussed with different reference numbers, it is understood that the features of any the furnaces described herein may be combined or replaced as desired.

As described above, furnaces for additive manufacturing may experience contamination due to the introduction of moisture and/or binder into a chamber containing one or more parts. This contamination may result from substances that are absorbed and released from one or more layers of insulation. However, contamination may result from other mechanisms, including release of contaminants from other structures of the furnace system or from within the furnace, leaky seals at inlets, outlets, and/or a door of the furnace, etc. Thus, it may be possible to improve the functioning of a furnace system by addressing one or more of these sources of contamination, such as with the exemplary solutions disclosed herein, which may be individually incorporated in to a furnace system or may be used in combination with one another.

Furnaces, and in particular sintering furnaces, often have large power requirements. For example, a relatively small sintering furnace with a work zone of about 1 cubic foot may require approximately 20 kW to 40 kW of power. Larger furnaces (e.g., furnaces with work zones of about 4 cubic feet to about 8 cubic feet) may require even more power, on the order of one-hundred to several-hundred kW of power. Sintering may require the application of this power for a prolonged period of time (e.g., multiple hours). The application of high levels of power for such extended periods of time represents significant costs and energy usage. For example, sintering cycles in relatively larger furnaces may be associated with energy costs in the hundreds of dollars, or more, per cycle. Additionally, commercial furnaces may operate frequently (e.g., on a nearly-continuous basis), in order to maximize productivity. Each of these furnaces may operate for about 1,000 hours per year, corresponding to several megawatt hours of power on an annual basis.

Smaller furnaces (e.g., smaller tube furnaces typically used in laboratory research) may tend to require less energy by including additional insulation. However, these furnaces may not be suited for use in manufacturing. Furthermore, these furnaces may not be usable under a vacuum, which applies a controlled, negative-pressure environment to the interior of the furnace, reducing the amount of contamination in the atmosphere, and the amount of undesired products, such as binder, that is emitted into the atmosphere.

For at least the above-described reasons, commercial and laboratory furnaces may be inefficient and may increase pollution, both directly (from emissions) and indirectly (due to large power requirements).

The solutions described below may provide one or more environmental benefits, including reduced pollution, costs, and energy usage. For example, one or more of the furnaces described herein may have power requirements (e.g., about 2 kW to about 4 kW) that are approximately 90% less as compared to the requirements of some commercial furnaces. One-thousand large, metal-sintering furnaces operating at 10 killowatts power for 1000 hours per year may be expected to consume 10 million watt hours per year. As a comparison, a typical residential American home may be expected to consume 10 million watt hours per year. Accordingly, assuming there are 1,000 or more large metal-sintering furnaces currently in operation, energy and associated reductions in pollution may be expected to a 1000 homes. Moreover, if comparable energy-saving techniques were employed in the ceramic-sintering and firing industries (which are larger than the metal-sintering industry), these energy savings may be doubled, tripled, or even greater.

FIG. 1 is a cross-sectional partially-schematic view of a furnace system 10 including a furnace 100 introduced for the purposes of providing context to the disclosure of a compound furnace. In the exemplary configuration illustrated in FIG. 1, furnace system 10 may include, in addition to furnace 100, a power system 82, an environment control system 58 for controlling the sintering environment especially in the work zone where parts are processed, and a system controller or furnace controller 76. Furnace system 10 may include furnace, 590, and/or 600, which is described below. Furnace 100 may be employed in a variety of heat treatment processes such as debinding and/or sintering. Furnace 100 may be a vacuum furnace configured to create a controlled atmosphere with environment control system 58, and may include an air-tight sealed chamber 20. Such a sealed chamber 20 may prevent or inhibit the entry of ambient air and/or prevent or inhibit contamination by leakage from the outside air of process gas (e.g., an inert gas pumped into the chamber 20). In some aspects, chamber 20 may be sealed in a manner that forms approximately complete blockage or hermetic sealing with respect to an atmosphere external of furnace 100.

However, chamber 20 may be sealed to a lesser degree, for example sealing that may inhibit or limit leakage of gas. In some case, for operation at vacuum, the airtight outer chamber may be sealed as well as sturdy enough to withstand 15 psi. I other cases where the outer airtight chamber will only need to support atmospheric pressure on both sides and does not need to be very sturdy.

Furnace 100 may include a housing wall 32 that defines chamber 20 within which insulation 22 and heaters 112 may be located. Heat generated by heaters 112 may debind and/or sinter parts 90 placed within chamber 20. In one aspect, the central cavity or chamber 20 within furnace 100 may define a parts cavity 116, which is inside of a retort 114 in which parts 90 may be supported (e.g., via one or more parts holders or shelves 34 and support brackets 35 for supporting each shelf 34, although any suitable shelving configuration is contemplated). Retort 114 may be located within a hot zone 28 defined by one or more layers of insulation 22, including inner or exposed insulation 24. An inward-facing surface of an inner-most layer of insulation 24 may form a hot face 44 that surrounds hot zone 28. Hot zone 28 may represent an area surrounded by hot face 44 of exposed insulation 24.

In an exemplary configuration, one or more heaters 112 (e.g., a plurality of separate heaters with helical heater elements, separate or continuous serpentine heater elements, or any other suitable heater or group of heaters) may include electrically-resistive heater elements that extend between retort 114 and inner insulation 24 in hot zone 28. These heaters may generate heat 14 within hot zone 28 to provide uniform heat to parts 90. One or more layers of isolated or outer insulation 26 may surround the one or more layers of inner insulation 24. An outer periphery or cold face 46 of an outermost layer of outer insulation 26 may define a cold zone 30. An outer cooling jacket 38 may be provided, if desired, to prevent excess heat accumulation within cold zone 30. The inclusion of cooling jacket 38 may decrease the amount of dissipated heat 92 that exits furnace 100.

In order to generate heat in a controlled manner, furnace power system 82 may supply electrical energy that is converted into heat by heaters 112. Each heater 112 may be connected to a suitable power supply 84 which may receive power from main power source 86. In some aspects, main power source 86 may correspond to a commercial or residential standard power source (e.g., a 240V power source). Electrical connections between power supply 84 and one or more heaters 112 may be provided via one or more power feedthroughs 88 that extend through housing wall 32. Power supply 84 may provide AC or DC power to heaters 112 based on commands from furnace controller 76.

Environment control system 58 may include systems for applying a vacuum to furnace 100, as well as systems for injecting an inert gas into furnace 100. For example, a gas manifold 74 may include one or more process gas feedlines 78 and effluent gas or vacuum lines 73 outside of furnace 100. Gas feedthroughs 66 may connect each external line 73, 78 with an interior of furnace 100. As shown in FIG. 1, pumping manifold 74 may receive process gas from a gas supply line 72. Pumped process gas 71 may be supplied to furnace 100 by a mass flow controller 70 that includes one or more suitable supply pumps. Process gas 71 may be an inert processing or process gas such as a reducing gas mixture containing a small amount of reactive hydrogen, a gas containing hydrogen as the dominant processing gas, or any suitable gas or mixture, such as a substantially oxygen-free gas. Process gas 71 may enter a process gas inlet tube 77 connected to process gas line 78 via one of the feedthroughs 66. An inlet gas distributor 42 within retort 114 may distribute the process gas 71 to an interior of retort 114. Additionally, process gas 71 may be pumped to chamber 20 within vacuum housing wall 32, if desired, by a process gas line 78.

Environment control system 58 may facilitate application of a vacuum to furnace 100. This vacuum may facilitate removal an effluent 75, which may contain a mixture of process gas, vaporized binder, and other offgas from parts 90 and/or components of furnace 100. Vacuum-applying components of environment control system 58 may include, for example, one or more vacuum pumps 60 connected via gas feedthroughs 66 (e.g., through an exhaust and or vacuum manifold) to cold zone 30 and hot zone 28 via vacuum valves 62. Therefore, vacuum may be applied to an interior of retort 114 and/or chamber 20 defined by vacuum housing wall 32. When vacuum is applied to chamber 20, vacuum housing wall may be formed as an air-tight sealed housing that is configured to withstand vacuum pressure. In the exemplary configuration illustrated in FIG. 1, vacuum lines (or tubes) 73 may extend through gas feedthroughs 66 to receive effluent 75 from effluent lines (or tubes) 79, which are in fluid communication with retort 114. A binder trap 64 may be in fluid communication with vacuum lines 73 to receive and/or treat effluent 75 pumped via vacuum pump 60. One or more vacuum lines 73 may be in communication with insulation 22, to remove contamination that may offgas from one or more layers of insulation, as described below.

One or more temperature sensors 80 may be provided within hot zone 28 to monitor and provide feedback information indicative of a current temperature within hot zone 28. Additional temperature sensors 80 may be positioned in other locations of hot zone 28, such as on hot face 44, for example. Additional temperature sensors 80 may be positioned on outer insulation 26, on or in vacuum housing wall 32, or any other desired location. One or more vacuum pressure sensors 68 may be provided to measure a strength of the vacuum applied at one or more locations of furnace 100. For example, a pressure sensor 68 may be applied to measure a pressure of chamber 20, as shown in FIG. 1. Furnace controller 76 may be any suitable control system including one or more processors, memory devices, input output devices, etc., to receive feedback information e.g., from temperature sensor(s) 80 and pressure sensors 68. Controller 76 may be a system-level controller configured to monitor furnace conditions and to generate commands to control the operation of environment control system 58, including vacuum pump(s) 60, valves 62, and mass flow controller 70, as well as heaters 112 via power supply 84.

Furnace system 10 may be configured to generate an atmosphere-controlled furnace environment via environment control system 58. While a vacuum furnace may include an atmosphere control system, such as system 58, not all atmosphere-controlled furnaces may be vacuum furnaces. A vacuum furnace may form an atmosphere-controlled furnace, when appropriately sealed to provide and withstand vacuum pressure. In at least some embodiments, vacuum furnaces, such as furnace 100 (and the other exemplary furnaces described herein), may be configured to operate at a range of pressures, including deep vacuum, such as about $10^{-6}$ millitorr, to about one atmosphere (760 Torr). If desired, furnace 100 may be suitable for use at modest positive pressures. Typical operation involves operating at debinding pressures that are between 1 torr and 500 torr and sintering pressures from 10 millitorr to 400 torr, or in certain applications atmospheric pressure. One of the advantages of the present application is that purity levels can be achieved similar to those typically found in ultra-high vacuums but without the necessity to operate at extremely low pressures.

Furnace 100, which may be formed as a vacuum sintering furnace, may utilize a controlled flow of processing or process gas 71 while simultaneously pumping with vacuum pump(s) 60 in a manner balanced by controller 76. The introduction of process gas 71 and application of vacuum (which removes effluent 75) from chamber 20 and/or parts cavity 116 may control the atmosphere to which parts 90 are exposed. Vacuum pressure may be measured with vacuum pressure sensor 68 in order to facilitate control over the vacuum by controller 76. For example, controller 76 may be configured to balance an inlet flow rate (e.g., of process gas 71) in opposition to outlet gas flow (e.g., of effluent 75). A manual pressure gauge may be provided instead of, or in addition to, sensor 68 to facilitate manual monitoring and/or control over flow balancing. The flow of outlet gas or effluent 75 may be controlled manually or with controller 76, by adjusting the position of one or more electronically-controlled or adjustable valves 62 and/or by changing the pumping rate of pump(s) 60. In a similar manner, flow of process gas 71 may be controllably varied by mass flow controller 70, which may be controlled by controller 76. While mass flow controller 70 and furnace system controller 76 are illustrated as separate devices, as understood, mass flow controller 70 and system controller 76 may be combined in a single system controller. One or both of controllers 70 and 76 may be implemented by any suitable combination of programmable logic controllers (PLCs), computers, etc. Controllers may include open-loop feedback devices, closed-loop feedback devices, and/or state machines. If desired, suitable controllers may include custom microchip-controlled embedded controllers. In some embodiments, furnace controller 76, mass flow controller 70, or both, may be connected to one or more computers through serial or parallel buses, Ethernet, WIFI, Bluetooth, intranet, cellular, LAN, WAN, internet or any other suitable wired connection, wireless connection, or combination thereof. During thermal processing, parts 90 may outgas, especially during debinding processes, as can the housing of furnace system 10 itself, including insulation 22 and retort 114. In some aspects, these outgassing rates may affect the pressure and the control over pressure achieved by controllers 70 and/or 76. The above-described balancing may be influenced by, and/or may be performed in response to, outgassing from parts 90 and/or components of system 10.

In order to reach and maintain temperatures suitable for thermal treatments, such as debinding or sintering, an arrangement of high-temperature (high-temperature resistant) thermal insulation 22 may be located in an interior of furnace 100 with respect to wall 32. Insulation 22 may allow furnace 100 to operate at power requirements that are within desired or practical limits. In one aspect, insulation 22 may be sufficient to allow heaters 112 to reach sintering temperatures when furnace system 10 is connected to a standard power source (main power source 86). Insulation 22 may further avoid excessive heating of components located outside of insulation 22, such as system components and/or components within the room in which furnace 100 is present. Insulation 22 may also limit temperatures that furnace parts themselves, such as wall 32, feedthroughs 66, 88, etc., are exposed to.

In some aspects, insulation 22 may include high-performance insulation. Insulation 22 may completely surround heaters 112 and may have a low number of cracks, holes, and other paths through which parasitic heat leakage may occur for a given amount of heating power. In some aspects, the maximum achievable temperature (e.g., a temperature within hot zone 28) for a set of heaters 112 may be associated with a combination of factors including one or more of: (i) a surface area of hot face 44 (increased surface area requires more power), (ii) a type and quality of insulation 22, (iii) a thickness of insulation 22, (iv) the overall condition of insulation 22 with respect to aging, wear, and damage, and (v) the quantity of vacuum pressure applied by pump(s) 60, for example. Regarding the surface area of hot face 44, larger furnaces (having larger hot zones) may require more power for a given insulation type and thickness. Power requirements may be generally proportional to this surface area.

In an exemplary type of insulation 22, heat shielding insulation 22 may include multiple thin layers of refractory metal, such as molybdenum and/or tungsten. This insulation may be particularly useful with refractory heaters 112 that include refractory metal material inside sealed vacuum housing 32. Each layer of material of insulation 22 may act as a radiation shield with a plurality of layers acting together in a layered or stacked arrangement to maintain hot zone 28 at high temperatures (such as sintering temperatures), while maintaining an exterior (e.g., wall 32) at significantly lower temperatures, and in some embodiments, nearly at room temperature. System 10 may optionally include a cooling jacket 38, such as a water cooling path that surrounds a portion or entirety of an exterior of chamber 20.

One or more layers of insulation 22 may include metal materials, such as refractory metal materials. Suitable refractory metal materials may include or may be based on molybdenum and/or tungsten. Refractory metal insulation material may be advantageous for use in layered insulation for establishing and maintaining a high purity atmosphere within furnace 100. For example, molybdenum and tungsten have sufficient resistance to degradation from heat, vacuum, and exposure to process gas. These materials may also experience limited water and/or binder uptake or absorption. However, molybdenum and tungsten may provide a lower resistance to heat transmission in comparison to other insulation materials, and may tend to increase power requirements and cost.

Instead of, or in addition to refractory metal, insulation 22 may include high-temperature fiber insulation that operates, in principle, in a manner similar to fiberglass fiber insulation used in traditional home construction. High-temperature fiber insulation suitable for insulation 22 may include lightweight graphite fiber material. As used herein, the phrase "graphite insulation" may include graphite fiber insulation. Graphite insulation included for use in insulation 22 may be produced in rigid form as rigid fiber board with a volumetric fill factor (e.g., the ratio of fiber volume divided by the total spatial volume occupied by the rigid board) of less than 100% such that the board has low density, and is thus lighter in weight, as compared to solid graphite. Individual graphite fibers may tend to be most thermally conductive in the direction of the fibers. Thus, highly-oriented sheets or boards of graphite fiber insulation may exhibit anisotropic performance. Insulation 22 may include graphite fiber insulation fabricated in flat or curved planar layers with fibers generally extending parallel to the layer and perpendicular to the direction of heat flow (e.g., perpendicular to heat 14 on a given side of insulation 22). In square or rectangular furnaces, insulation 22 may include flat boards with fibers oriented along lateral extents of the boards such that highest resistance to heat conduction occurs in a direction perpendicular to the board. Insulation 22 may also include graphite fiber formed as a semi-rigid or non-rigid graphite felt with fibers oriented along the lateral extents of the felt. Cylindrical furnaces with cylindrical hot zones may be constructed by wrapping layers of such felt to form a layered cylinder of insulation 22. When insulation 22 includes graphite fiber, suitable heaters 112 may include electrically-resistive graphite heaters 112.

In at least some aspects, insulation 22 may include a relatively lightweight ceramic fiber insulation material. Similar to graphite insulation 22, ceramic fiber insulation 22 may be in the form of one or more rigid fiber boards with a volumetric fill factor of less than 100% such that the board has lower density and lighter weight as compared to solid ceramic. While improved thermal performance may be achieved by arranging ceramic fibers generally perpendicular to the direction of heat flow, ceramic insulation may be relatively thermally isotropic regardless of the arrangement of the fibers. Thus, ceramic fibers may generally be arranged parallel to the direction of heat flow if desired. In rectangular furnaces, ceramic insulation 22 may include flat boards including ceramic fibers oriented at least partially in parallel with the lateral (long) direction of the board. Similar to graphite fiber insulation 22, ceramic fiber insulation 22 may include non-rigid ceramic felt. Cylindrical furnaces 100 with cylindrical hot zones 28 may be constructed by wrapping layers of ceramic felt to form a layered cylinder of insulation 22. As used herein "ceramic insulation" may include ceramic fiber insulation. Exemplary ceramic insulation 22 materials may include alumina and mullite mixtures, or other ceramic materials, in any suitable grade or density. Any suitable heater 112 may be used in conjunction with ceramic insulation, such as SiC heaters, molybdenum disilicate heaters, or refractory metal heaters.

Each of the above-described materials for inclusion in insulation 22 (refractory metal insulation, graphite insulation, and ceramic insulation) may be selected based at least in part on the desired design and application of furnace 100. For example, graphite insulation 22 may remain mechanically robust at temperatures up to or greater than 2,000 degrees C. for hundreds or thousands of cycles, while ceramic fiber insulation 22 may be useful at somewhat lower temperatures, such as 1,600 degrees C. Commercially-available graphite insulation products include rigid, semi-rigid and flexible felt configurations, which may be suitable for inclusion in insulation 22. The maximum operating temperature of ceramic insulation 22 may be influenced by the purity of the ceramic material and density. In order to maximize the temperature resistance of ceramic insulation 22, it may be desirable to employ high purity alumina and/or high-density boards. Various forms of ceramic insulation 22 may provide a higher degree of thermal insulation as compared to graphite, even for forms of ceramic that have a lower maximum operating temperature.

Figure 2:
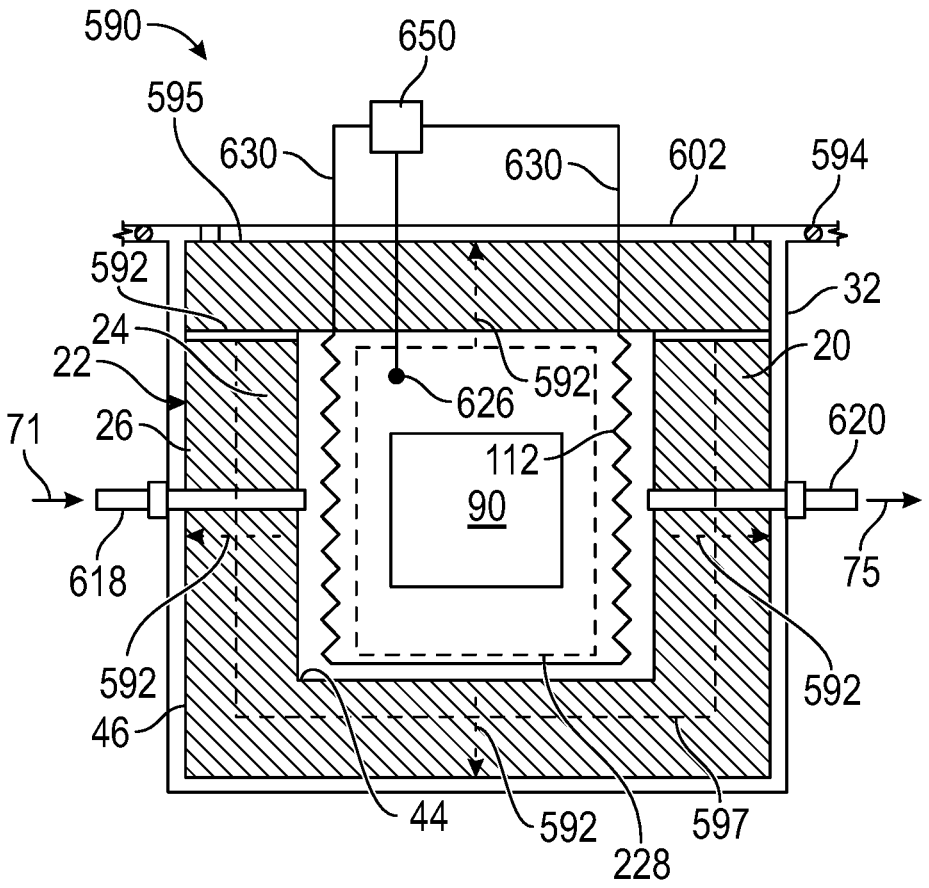
FIG. 2 is a cross-sectional view of a furnace according to one or more aspects of the present disclosure.

FIG. 2 illustrates an exemplary furnace 590 useful for performing thermal processing of one or more parts 90 by generating a controlled amount of heat with one or more heaters 112 and a work zone controller 650. Work zone controller 650 may include one or more control devices, power, units, etc., that receive temperature information from a temperature sensor 626 (which may correspond to temperature sensor 80; FIG. 1), and provide electrical power to heaters 112 via heater power feeds 630. A wall 32 of furnace 590 may define a chamber 20 including insulation 22 and heaters 112. A door 602 may be removably received on housing wall 32 via a main door seal 594. One or more layers of door insulation 595 may be secured to, and removable with, door 602. Insulation 22 of furnace 590 may be relatively thick insulation that encloses a heated work zone 228. Insulation 22 may include one or more layers of inner and/or outer insulation 24, 26, as described above. A boundary between one or more types of insulation, such as exposed isolation 24 and isolated insulation 26, is represented by the boundary 597 in FIG. 2. Process gas 71 may be introduced by a sealed gas inlet feed 618 and may flow over one or more parts 90. Effluent 75 (including process gas 71 mixed with one or more of volatized binder, or off-gas byproducts from one or more components of furnace 590) may be pumped (by one or more vacuum pumps) to an exterior of furnace 590 through sealed exhaust outlet 620.

Due to the presence of gaps, cracks, or other imperfections in insulation 22, including door insulation 595, one or more paths of heat leakage 592 may occur when heaters 112 are activated. As shown in FIG. 2, heat leakage 592 may occur in paths extending through one or more layers of insulation 22, or may occur through seams between insulation portions, such as door insulation 595 and insulation in chamber 20.

Furnace 590 may include a sealed housing formed, at least in part, by housing wall 32. In at least some configurations, housing wall 32 may provide a vacuum-resistant housing that can withstand vacuum pressure up to at least about 13.5 psi (about 700 Torr) or at least 15 psi (about 775 Torr). Furnace 590 may also be operable at room temperature environments. The housing of furnace 590 may include door 602, as well as door seal 594 to facilitate loading and unloading of a mass of one or more parts 90. The furnace housing may enclose an arrangement of insulation 22, which defines inner hot face 44 that faces heaters 112 and work zone 228, and an outer cold face 46 that faces housing wall 32. Insulation 22 may include one or more layers of inner insulation 24, and one or more layers of outer insulation 26. In one aspect, these layers of insulation may have the same or similar grade (density and/or maximum use temperature). However, if desired, inner insulation 24 may be relatively high grade insulation (e.g., high density and/or higher maximum use temperature) that extends closer with respect to the inward-facing hot face 44, while outer insulation 26 may include relatively lower grade insulation (e.g., lower density and/or lower maximum use temperature) that extends closer with respect to the outward-facing cold face 46.

Furnace heaters 112 may include any of the materials described herein, such as silicon carbide or graphite. Heaters 112 may receive electrical current through one or more heater power feeds 630 which could include a conductive electrode such as a wire that is electrically insulated relative to the housing and sealed with respect to the housing by an electrical feedthrough such as a commercially available ceramic to metal sealed feedthrough, and the electrical current may be converted into heat by resistive heater elements of heaters 112 to heat work zone 228. In an exemplary configuration, work zone 228 may provide approximately one cubic foot of space. Work zone 228 may be configured to reach temperatures suitable for sintering, such as approximately 1,250 to 1,500 degrees C. To facilitate the maintenance of such temperatures, insulation 22 may include approximately 4-inch to approximately 5-inch thick graphite and/or ceramic fiber insulation. One or more differing grades and/or densities of insulation may be included, as described above, or each layer of insulation may have approximately the same grade and/or density.

The part or parts 90 loaded into work zone 228 may have a total mass of approximately 5 kg or less, although larger furnaces 590 may have larger capacities. In some aspects, furnace 590 may be capable of operation at approximately 1,250 to 1,500 degrees C. with maximum ramp rate (temperature rate of rise) of between approximately 5 degrees C. per minute and approximately 10 degrees C. per minute. Furnace 590 may be configured to maintain a steady-state temperature of 1,250 to 1,500 degrees C., or higher, and may have a holding power within a range of approximately 1.5 kW to approximately 4 kW. Different steady-state temperatures and holding powers may be achieved by modifying insulation 22. One or more temperature sensors 626, such as a thermocouple temperature probe or thermistor, may be operably coupled to work zone 228 or another portion of furnace 590 and may transmit temperature information to control system 650.

In some aspects, furnace 590, as shown in FIG. 2, may employ natural or lightly-forced convection to achieve the above-described steady-state housing temperatures. Furnace 590 may have housing hot spots of up to between approximately 100 degrees C. and approximately 150 degrees C. above the steady-state housing temperature and housing cold spots of between approximately 50 degrees C. and approximately 100 degrees C. below the steady-state housing temperature during operation. In one aspect, "steady-state" sintering temperatures of the work zone may correspond to temperatures of approximately 1,250 degrees C. to approximately 1,500 degrees C. in work zone 228 that may be held or maintained for prolonged periods of time, e.g., several hours at such temperatures. The temperature may be monitored intermittently or continuously, or according to any suitable schedule, during debinding and sintering, for example, by way of temperature sensor 626 extending inside furnace 590 and, e.g., operably coupled to control system 650 or any suitable display or control device. Control system 650 may correspond to system control unit 76 and/or power supply 84, and may be configured to controllably vary power applied to furnace heaters 112 based at least in part on measurements taken by temperature sensor 626.

Furnace 590 may include insulation 22 having a relatively large thickness. In some aspects, the thickness of insulation 22 may be a larger than insulation provided in a high-power water-cooled industrial furnace having a similar work zone. However, as discussed above, insulation may be porous and/or prone to absorption and re-emission of contaminants. The amount of contamination retained and subsequently emitted by insulation 22 may be further exacerbated by eliminating water cooling and thus requiring thicker insulation. By replacing water cooling with air cooling, the outer surface of the shell (e.g., outer surface of wall 32) may experience temperatures of approximately 100 degrees C. during sintering operations. In such a configuration, cold face 46 of insulation 22 may experience temperatures of between approximately 200 degrees C. and approximately 300 degrees C., or lower, by providing relatively thick insulation. Furnaces having a configuration corresponding to furnace 590 of FIG. 2, with relatively thick insulation 22, may be prone to absorption and re-emission of contaminants as: (i) there may be more insulation able to become contaminated, and/or (ii) during debinding, initial sintering, or both, the outer cold face 46 layers may be at temperatures well under 100 degrees C., at which insulation 22 (e.g., insulation 26) may be absorptive to contaminants (e.g., contaminants that are emitted during debinding). For example, cold face 46 of insulation in an air-cooled graphite furnace with approximately 6 inches of insulation 22, may operate at less than approximately 40 degrees C. At such temperatures, volatized binders may condense on insulation 22. Subsequently, during sintering, cold face 46 of insulation 22 may reach between approximately 100 degrees C. and approximately 200 degrees C., at which condensed contaminants may be re-emitted during sintering.

Figure 3:
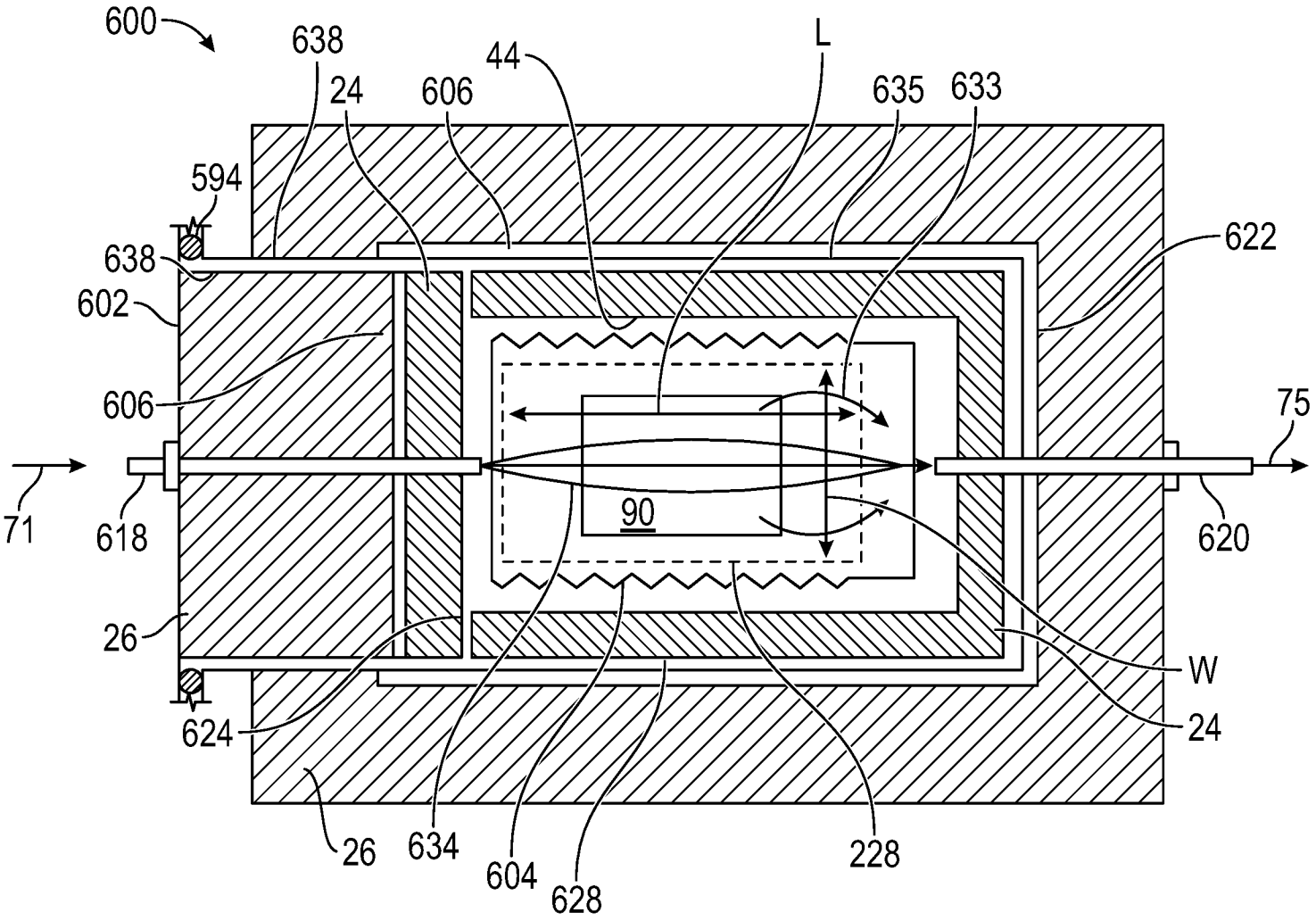
FIG. 3 is a cross-sectional view of a compound furnace.

FIG. 3 illustrates a furnace 600, which may form an exemplary compound furnace (e.g., a furnace including inner and outer insulation layers located in different portions of the furnace). Furnace 600 may include a plurality of primary or inner heaters 604, which may be substantially similar to heaters 112. For example, inner heaters 604 may include serpentine heaters, heater coils, or one or more heaters having any appropriate form. Work zone 228 may have a length L and a diameter or width W defined inward with respect to heaters 604 and may define a platform, recess, shelf, or other structure suitable for loading one or more parts 90.

Furnace 600 may include a sealed chamber 628 as a space having a shape and volume that is defined by an interior volume of temperature-resistant sealed housing 635. Housing 635 may be formed, for example, by a tube (or other suitably shaped structure) including a high temperature resistant refractory metal, ceramic or otherwise temperature-resistant material. While housing 635 and chamber space 628 may be described as having cylindrical shapes, as understood, housing 635 and chamber space 628 may have square, rectangular, or other suitable shapes. Housing 635 may be sealed at a closed or sealed end 622 and may include a main opening or open end 624 (which may be closed by door 602). Door 602 may mate with, e.g., be received through, open end 624 of housing 635 such that an end of door 602 (e.g., an end that receives inlet 618) may extend to ambient air outside of furnace 600. Main door seal 610 may, when door 602 is closed, be positioned adjacent to ambient air outside of furnace 600. Therefore, main door seal 610 may experience sufficiently cool temperatures (e.g., less than or equal to approximately 300 degrees C.) to allow and/or facilitate the inclusion of an elastomeric seal for seal 610. In one aspect, an elastomeric seal 594 may include a gasket or o-ring including a silicone-based material or other appropriate polymer.

A temperature-resistant a housing 635 including one or more of: (i) a refractory non-metallic material (e.g., mullite, alumina, or SiC); (ii) a refractory metal material; or (iii) a temperature resistant metal (e.g., nickel, nickel alloys, or other metals that have maximum use temperatures exceeding approximately 800 degrees C. and/or melting temperatures exceeding approximately 1,350 degrees C.).

A relatively thin layer of exposed inner insulation 24 (e.g., high-temperature-resistant exposed insulation) may be secured within chamber 628 inward of the housing walls. Insulation 24 may define a hot face 44 due to heat from heaters 112. The area within hot face 44 may define work zone 228, such that one or more parts 90 may be supported within work zone 228. When housing 635 includes metal material, the metal may include nickel, nickel alloys, 310S stainless steel, Kanthal metal (FeCrAl), or a refractory metal that can withstand operating temperatures of approximately 800 degrees C. or greater, or in particular, approximately 1,000 degrees C. or greater. While it may be desirable to form housing 635, which may be in the shape of a tube or rectangle, for example, of a metallic material, there is no requirement that housing 635 include metal. For example, housing 635 may include a ceramic, various forms of SiC (e.g., nitride bonded SiC, reaction bonded SiC, sintered SiC, etc.) and/or other refractory materials. It is noted that the materials forming housing 635 may be materials that are compatible with ambient oxygen at high temperatures.

As can be seen in FIG. 3, at least a portion of housing 635 may be surrounded by an arrangement of outer insulation 26 and the outer insulation may surround the inner insulation. Outer insulation 26 may be isolated from the work zone 228 by any sealing technique(s) described herein. In some aspects, outer insulation 26 may be exposable to atmosphere, but sealed and therefor isolated with respect to chamber 628 by housing 635. As outer insulation 26 may be sealed and isolated by chamber 628 from work zone 228, outer insulation 26 may be formed of a lower-cost material that may tend to absorb and release relatively higher amounts of contamination. In some embodiments, silica and/or ceramic fiber insulation may be appropriate for one or more portions of insulation 26 especially those portions that are outside the sealed housing. In at least some aspects, insulation 26 may include one or more components formed with low cost materials similar to those used to produce high-temperature kilns. Inner insulation 24 may be more directly exposed to heat from heaters 604 and may experience relatively higher temperatures as compared to outer insulation 26. Therefore, outer insulation 26 may include a relatively higher grade possibly and higher cost furnace insulation material, such as, for example, graphite insulation, high-performance low silica ceramic insulation, or one or multiple refractory layers (e.g., molybdenum and/or titanium).

Figure 5:
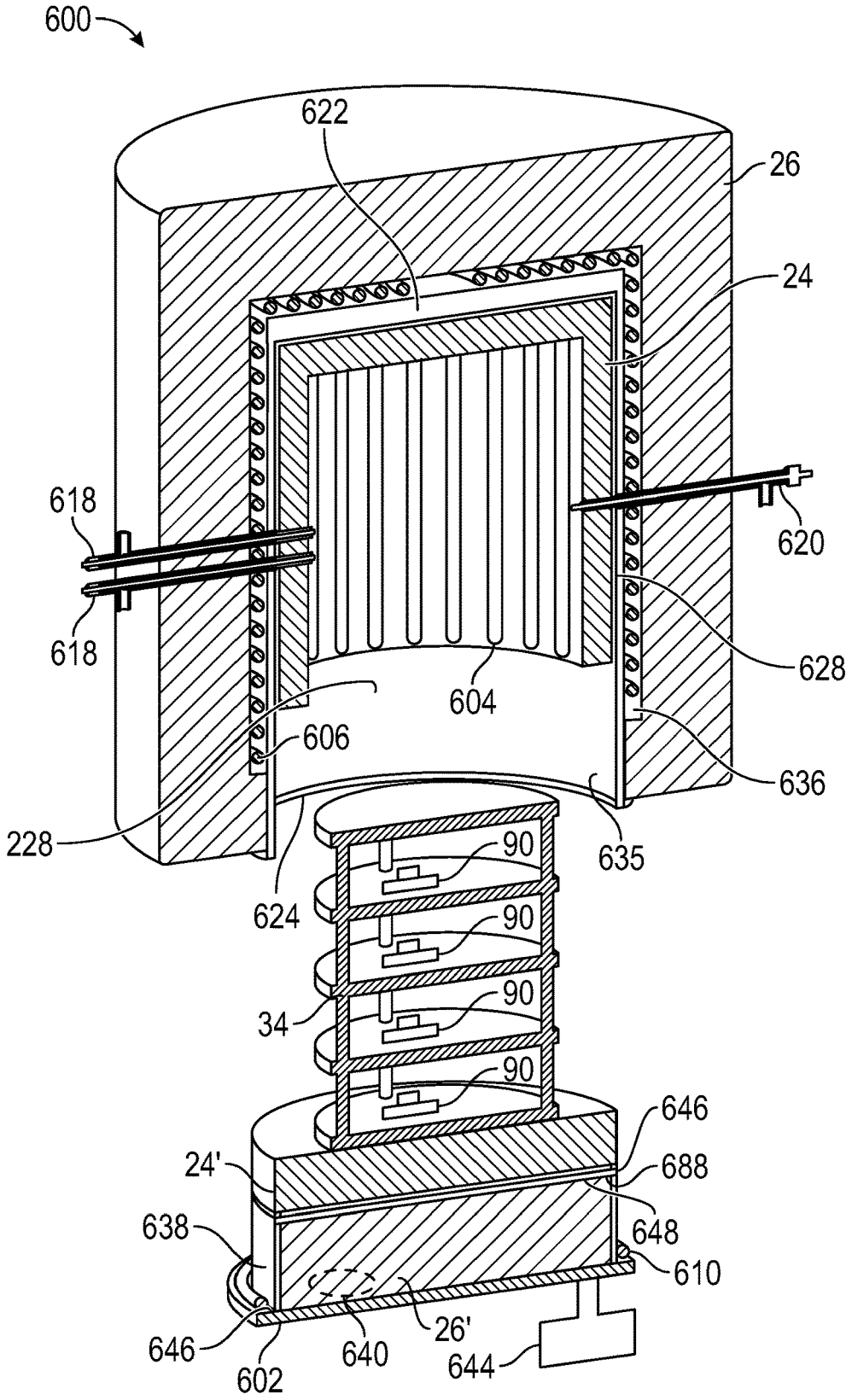
FIG. 5 is a cross-sectional partially schematic view of a compound furnace in an open position.

Referring to the embodiment of FIG. 5 inner and outer door Insulation 24', 26' on or within door 602 may be provided as a door insulation arrangement that moves as a unit with the door 602 (see FIG. 5). Outerdoor Insulation 26' within door 602 may be formed as a plug of insulation surrounded and sealed by a tube or door housing 638 formed of the same material as housing 635 or by thin foil of refractory metal that is supported by the door insulation therein. Alternatively, door housing 638 may be formed of a different material as compared to housing 635. The plug or arrangement of outer door insulation 26' on door 602 may facilitate the formation of a hermetic seal between the outer door insulation 26' and work zone 228. Similar to the tube or chamber 635, to achieve hermetic sealing, the plug of sealed insulation on door 602 may be sealed by seam welding, as described below. A moveable plug of door insulation 22' on door 602, sealed, sealingly housed or otherwise, may facilitate the use of a relatively thin exposed door insulation 24'. In one aspect, inner exposed door insulation 24' on door 602 may be similar (or the same) in thickness and composition as compared to inner exposed insulation 24 located in other portions of the furnace. In some cases, and as discussed below, door 602 may support a relatively thick layer of inner door insulation 24' or outer door insulation 26' compared to inner and outer insulations 24, 26 secured by wall 32, for example.

As illustrated in FIG. 3, process gas 71 may be supplied by an inlet 618 formed in door 602. Process gas 71 may form a flow 634 of gas that passes around parts 90 in work zone 228. Effluent 75 may be withdrawn from work zone 228 via one or more vacuum pumps (not shown) connected to outlet 620. Effluent 75, may include offgassing 633 from parts 90 (e.g., binder) and process gas 71. In other words process gas 71 and offgassing 633 may combine as parts of Effluent 75 that exits work zone 228 via outlet 620. While inlet 618 and outlet 620 are illustrated as extending through door 602 and opposing portions of insulation 24, 26 adjacent to closed end 622, inlet and outlet 618, 620 may be provided at any other suitable positions. For example, as shown in FIG. 5, inlet and outlet 618, 620 may extend approximately orthogonally with respect to an insertion or removal direction of door 602. As understood, inlet and outlet 618, 620 may be provided in either of these positions, or in other positions, for each of the configurations described with respect to FIGS. 3 and 5-17. Inlet and outlet 618, 620 have been omitted from FIGS. 15-17, described below, in the interest of clarity of illustration, however, one of ordinary skill in the art will recognize that the furnaces of FIGS. 15-17 may include inlet and outlet 618, 620.

In some aspects, housing 635 may include 310S stainless steel alloy having a melting temperature of approximately 1,400 degrees C. and a service temperature (considered as a maximum use temperature) of approximately 900 degrees C. to approximately 1,200 degrees C. When 310S stainless steel or a similar material is used in housing 635, the thicknesses of inner 24 and outer 26 insulation may be established to cooperatively balance one another such that, for steady-state sintering temperatures of approximately 1,350 degrees C. or approximately 1,400 degrees C. within work zone 228, the alloy tube or housing 635 may reach a temperature of approximately 1,100 C, or less. Thus, the thicknesses of insulation 24, 26 may be balanced such that, for a particular amount of power applied to heaters 604, 606, housing 635 reaches a particular temperature.

Figure 4:
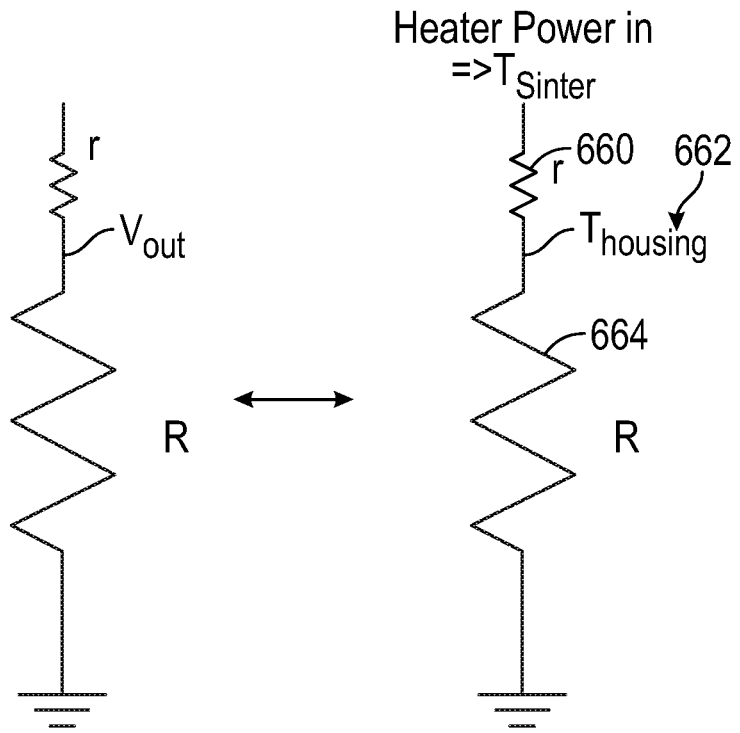
FIG. 4 is a schematic representation of thermal resistance in a furnace according to FIG. 3.

The steady state balance between insulation thickness and housing 635 temperature may be understood with reference to the DC electrical analogy illustrated in FIG. 4. As represented in FIG. 4, inner insulation 24 and the outer insulation 26 may be modelled—for conceptual understand or for approximate computational estimates—by electrical analogy as resistors, with inner insulation 24 having a resistance 660 of 'r' and outer insulation 26 having a resistance 664 of 'R'. A temperature of insulation 24 and insulation 26 may be modelled analogous to a voltage applied to these resistors. In both cases (electrical and thermal), for a given power input, and for a given total resistance (electrical resistance and thermal resistance, respectively), the output voltage $V_{OUT}$ represents temperature 662 of housing 635 and may be respectively balanced to a desired result by varying relative resistances. In this model, insulation 22 acts as a thermal analog to a DC voltage divider, with the work zone temperature (heater power in) modelled as the input voltage and housing 635 temperature 662 modelled as the output voltage $V_{OUT}$. As shown in FIG. 4, the heater power in may correspond to an amount of heater power necessary to reach a desired sintering temperature $T_{SINTER}$. To design a DC voltage divider, the relative resistances may be balanced to cooperatively provide a given steady-state. In this analogy, heating power is analogous to current. Stated differently, the inner and outer insulation layers may be balanced in their insulative properties relative to one another, via sizing, material selection and geometric configuration such that during sintering the housing can approach it's maximum temperature does not exceed that maximum temperature.

This balancing approach may be used to achieve a furnace 600 that may require less power to achieve the same or similar work zone temperatures, as compared to furnace 590 of FIG. 2. Moreover, furnace 600 may reach these temperatures without the need to include a water cooling system. This approach (as implemented in furnace 600) may require significantly less exposed and therefore contaminable insulation inside furnace 600, as compared to the furnace 590 or other furnaces lacking outer heaters and/or a sealed chamber. Furnace 600 may be operated in a manner that heats exposed insulation 24 to a suitably elevated temperature, e.g., a temperature significantly greater than 200 degrees C. during thermal debinding (and higher temperatures during sintering). This heating may reduce the tendency of volatized debinding byproducts (e.g., volatized binder) to condense on exposed inner insulation 24. With reference to furnace 600, "exposed insulation" may refer to inner insulation 24 that is secured within sealed housing 635, and, thus, is exposed to work zone 228. Conversely, isolated insulation 26 may be sealed with respect to work zone 228 and provided outside of housing 635. Thus, insulation 26 may be considered "isolated" insulation, as outer insulation 26 may be gaseously isolated from work zone 228. In this aspect, furnace 600 may include a compound (inner and outer) insulation system, with sealed inner insulation 24 inside sealed housing 635 and insulation 26 surrounding the sealed housing 635.

Furnace 600 may be thermally tuned to maintain one or more desired temperature balances such that desired sintering temperature is achieved in the work zone without exceeding maximum service temperature of the sealed chamber. In general, in some designs, it may be challenging to balance two insulations 24, 26 perfectly and to accommodate various temperature drifts and/or imperfections that may be expected, especially if there is a narrow design margin with regard to the maximum temperature housing 635 may experience without becoming damaged (maximum acceptable temperature). As used herein "design margin" refers to a difference between intended operating temperature of temperature-resistant housing 635 and the maximum acceptable temperature of the constituent material of housing 635. In general, it may be possible to build and tune individual furnaces 600 to achieve a narrow margin (e.g., an approximately 200 degrees C. margin). For example, when furnace 600 achieves a margin of 200 degrees C., insulation 24 and heaters 604 may be formed of a material that is configured to operate at temperatures at least 200 degrees C.

higher as compared to the maximum acceptable temperature of housing 635. With a sufficiently high margin (e.g., approximately 400 degrees C.) the system may be manufactured in a way that overcomes the above-mentioned challenges by using thicker exposed inner insulation 22 to ensure that the temperature of housing 635 is significantly lower than the maximum acceptable temperature of housing 635. However, as the margin is increased, system cost may increase, and the performance benefit may diminish as thicker exposed insulation 24 may be required. For example, systems may use a nickel tube or 310S stainless steel as temperature-resistant housing 635, which may be operable at sintering temperatures of approximately 600 degrees C. In order to sufficiently insulate housing 635 from work zone 228 having significantly higher temperatures, relatively thick insulation 24 may be employed. However, such thick inner insulation 24 may be susceptible to contamination and/or may be expensive. Additionally, it may be beneficial to ensure that the expected temperature of chamber 635 during sintering is sufficiently cooler than the maximum acceptable temperature, while taking into account the thickness of insulation 24.

Stated differently, the furnace of FIG. 3 can be employed by in practice requires comprises to achieve reliability. First, a large margin must be employed such that the actual operating temperature of the housing is targeted to be several hundred degrees lower than max service temperature. This approach tends to require thicker inner insulation which adds to cost. This first compromise leads to a second tradeoff, which is that there is no way to avoid a temperature gradient on the inner insulation and the cold side of the inner insulation will be at significantly lower temperature during debind that the hot face—this means that there will inevitably be some contamination on the outer cold face of the inner insulation.

FIG. 5 is a cross-sectional perspective view of furnace 600 with an alternate arrangement of sealed gas inlet feed 618 and sealed gas outlet feed 620, as compared to the arrangement illustrated in FIG. 3. In the exemplary configuration illustrated in FIG. 5, outer insulation 26 is illustrated as having a substantially cylindrical configuration that surrounds outer heaters 606. However, rectangular configurations or other configurations may be employed for the components of furnace 600.

As illustrated in FIG. 5, outer heaters 606 may be located between the housing and outer insulation 26 so as to surround chamber 628. I this embodiment the outer heaters are located outside sealed housing 635 but it should be understood that they could alternatively be located within the inner walls of sealed housing 635. Inner insulation 24 may be secured to and/or supported by an inner wall (e.g., a circumferentially-extending wall) of housing 635. Inner or primary heaters 604 may surround work zone 228 defined within inner insulation 24. Inner or primary heaters 604 may be formed by one or more serpentine heaters, helical heaters, or any other suitable heaters. One or more outer heaters 606 may be sandwiched between outer insulation 26 and housing 635. If desired, as shown in some subsequent figures but not in FIG. 5, one or more additional outer heaters 606 may be embedded within and movable with door 602. In one aspect, inner heaters 604 and outer heaters 606 may be independently controlled. For example, inner heaters 604 and outer heaters 606 may generate different levels of heat at different times. Heaters 604, 606 may be controlled responsive to different control signals from different control units or from a system-level control unit, as described in greater detail below.

Door 602 may be moveable to an open or loading position, as illustrated in FIG. 5, and may include a relatively thin-walled housing 638 having a cylindrical, rectangular, or other shape. In some embodiments the thin walled housing could be a thin foil supported by outer door insulation 26' Housing 638 may enclose one or more layers of inner door insulation 24' and outer door insulation 26' that are movable as a unit with door 602. A parts holder or shelf 34 may be configured to hold one or more parts 90 for insertion into work zone 228. In one aspect, insulation 26 may be isolated by housing 638. Insulation 24 may also be isolated within housing 638. Isolation of outer door insulation 26' within door 602 may be achieved by welding metallic material, such as 310S stainless steel foil, or a wall of tubular housing 638 to a plate 648 secured on door 602. For example, joints of door 602, such as an interface between plate 648 and housing 638, may be sealed (e.g., hermetically sealed) by welds 646. Thus, outer door insulation 26' may be hermetically sealed with respect to work zone 228. In some aspects, door 602 may be connected to a vacuum pump 644. Additionally or alternatively, to facilitate application of and maintenance of a vacuum to outer insulation 26', getters 640 may be included in outer door insulation 26'.

Feeds 618 and 620 may have cross-sectional areas that are approximately 20%, or smaller, as compared to a cross-sectional area of chamber 628. The configuration shown in FIG. 5 may avoid the need to disconnect inlet and outlet feeds 618, 620 from piping and/or tubing prior to removal of door 602, in contrast to the configuration shown in FIG. 3. Feeds 618 and 620 extend through outer insulation 26 but not through inner insulation 24, and are welded at weld joints 688 (as shown in FIG. 6) to housing 635.

Figure 6:
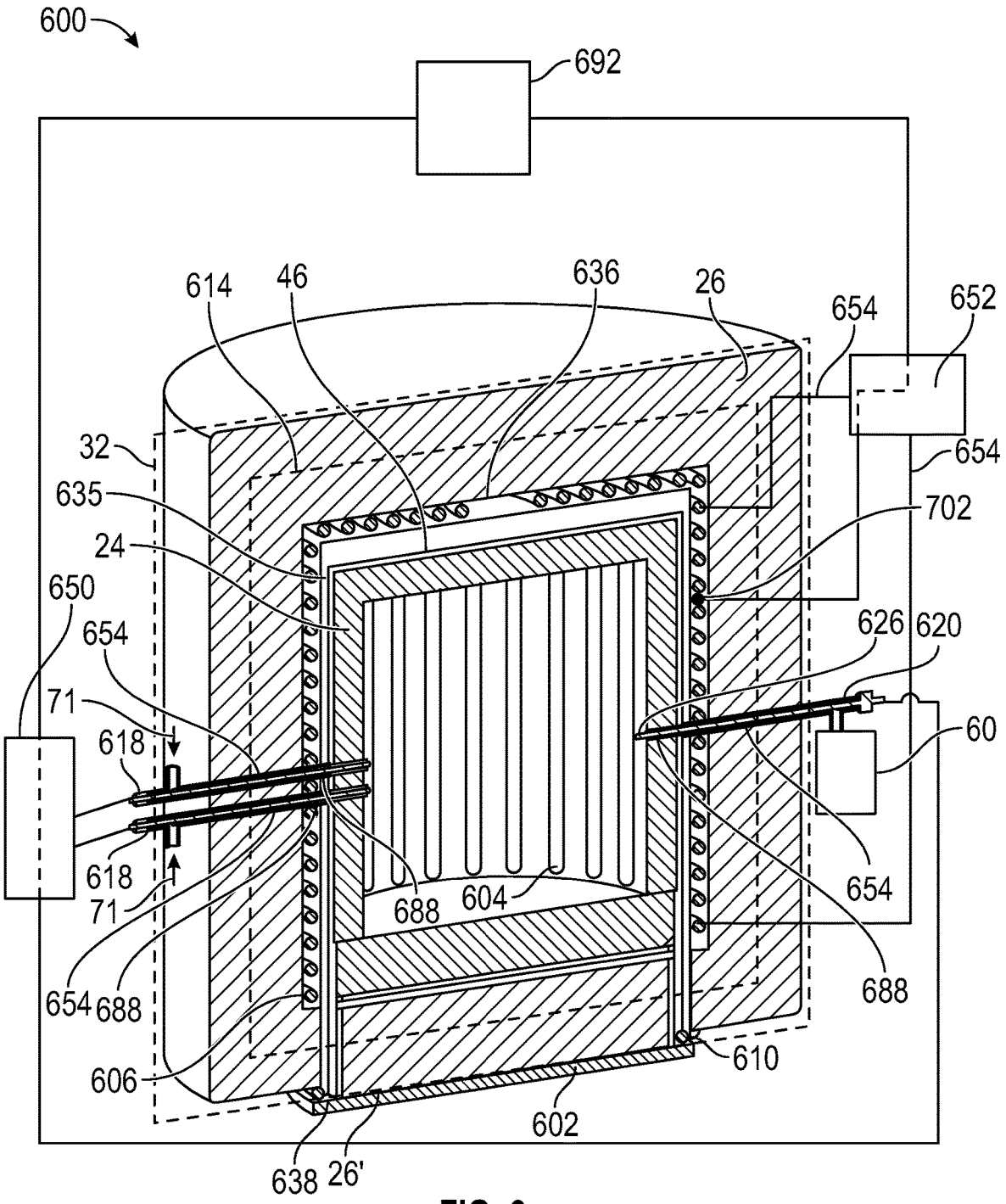
FIG. 6 is a cross-sectional partially-schematic view illustrating the compound furnace of FIG. 5 in a closed position.

FIG. 6 illustrates furnace 600 with door 602 in a closed position (e.g., a position for performing thermal processing). An additional optional feature i illustrated in FIG. 6 as an outside outer housing wall 32 that may surround insulation and form an air-tight or even a vacuum tight container or housing. This could provide for various benefits including but not limited to the enablement of a somewhat porous sealed chamber 635. For example if porous chamber 635 comprises somewhat porous Nitride bonded SiC the addition of an outside airtight and/or vacuum chamber could allow for overall high purity by providing 'layer' of gaseous isolation between the work zone and the outside ambient atmosphere. In addition to isolation an additional outside container and/or housing may provide for high margins of safety which could be useful for example in systems intended to run with high levels of hydrogen (100% hydrogen) as process gas.

Feeds 618 and 620 may be connected to a work zone controller 650 that may include a suitable control device (e.g., computing system) and a power supply. Details of these feeds will be discussed shortly. Work zone controller 650 may be operably connected to inner heaters 604 by electrodes 654. One or more of the electrodes 654 may extend within a housing of one or more inlets 618, as described in greater detail below. Electrodes 654 may be electrically isolated with respect to inlet 618 and outlet 620, by forming a tubing of inlets and outlet 618, 620 from an electrically-insulating material and/or providing an insulating layer of material surrounding electrodes 654 but preferably by maintaining the electrodes in the center of the tube spaced apart from the tube such that there is no physical contact therebetween. Electrode 654 (e.g., within outlet 620) may be connected to temperature sensor 626 and may generate a temperature feedback signal to work zone controller 650. Inner heaters 604 may be electrically connected to work zone controller 650 via electrodes 654. Thus, power may be controllably supplied to inner heaters 604 from controller 650 (or a separate power source) via electrodes 654.

Outer heaters 606 may be connected to one or more outer heater controllers 652 via electrodes 654, as schematically shown in FIG. 6. An outer chamber temperature sensor 702, such as a thermocouple temperature probe or thermistor, may extend to the outer chamber between insulation 26 and housing 635. Thus, controller 652 may control a temperature within outer or secondary chamber 636 in conjunction with information from sensor 702. While work zone controller 650 and outer heater controller 652 are illustrated as separate controllers that may be in communication with each other to apply sintering temperatures to work zone 228, controllers 650, 652 may be integrated as part of a single system controller, or may be in communication with (e.g., controlled by) a separate system controller 692.

In at least some aspects, outer heaters 606 may be activated simultaneously with the inner heaters by outer heater controller 652 during initial thermal processing, such as debinding, to assist in warming the outer peripheral surface of inner (exposed) insulation 24 to reduce or prevent condensation of volatized binders on or within inner exposed insulation 24. If desired, outer heater controller 652 may operate furnace 600 by applying an increased amount of power to outer heaters 606. The power applied to heaters 606 may gradually decrease or ramp down toward zero while power is increasingly applied to inner heaters 604 to increase or ramp up the temperature in work zone 228 to a sintering temperature. In some cases, it may be desirable to balance the power applied to inner and outer heaters during debinding such that a spatially uniform temperature (e.g., a suitable temperature for a debinding cycle) is maintained throughout, e.g., throughout the entire thickness, of the inner insulation 24. Work zone controller and power supply 650 may monitor temperature of the work zone 228 with at least one temperature sensor 626, while outer heater controller and power supply 652 may monitor the temperature of secondary or outer chamber 636 by at least one outer chamber temperature sensors 702.

It is noted that no insulation is "ideal" and that there may be thermal leaks in the outer insulation such as assembly joints and cooling paths and other imperfections. Thus, the theoretical optimum thickness and geometry should account for these thermal leaks. In one approach to mitigating leaks a designer could choose to provide design margin by erring on the side of adding thickness to the outer insulation. While this will ensure that the system remains well within a given power budget, it may cause the system to be more prone to overheating the housing especially if there is any failure or instability in the control system. Note that if the insulation is made thicker than optimum then it could be necessary to controllably add very low flow air cooling (for example as described with reference to FIG. 16), as part of controlling the housing temperature to ensure stability. In a different and possibly more practical choice a designer could compensate for thermal leakage by making the outer insulation thinner than optimum. This will require a predetermined but reasonable amount of extra power (for example 300 to 1000 Watts) during steady state sintering but it makes the system inherently more reliable against control failure and overheating.

Figure 7:
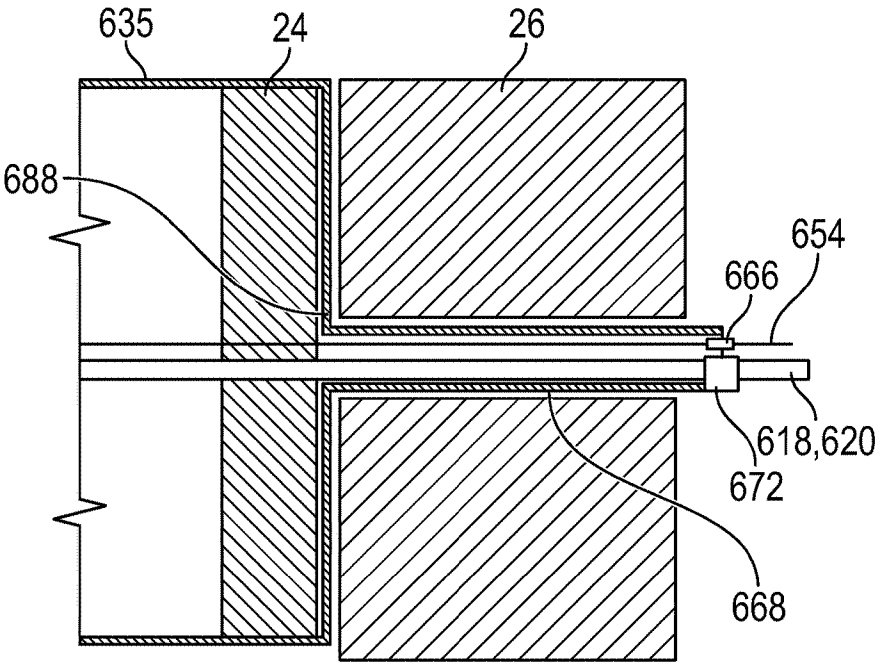
FIG. 7 is a cross-sectional view of an exemplary feedthrough.

Referring to FIG. 7 with ongoing references to FIG. 3 it is noted that temperature resistant housing 635 may extend as shown in FIG. 3 through outer insulation 26 such that seal 610 of door 602 extends into the ambient environment, where it may be sufficiently cool to facilitate use of conventional elastomeric seals. In an analogous manner, as is shown in FIG. 7, electrical, gas, and/or sensor feedthroughs may be located on the exterior, ambient side of the outer insulation 26. In some aspects, any suitable sealed vacuum feedthrough technique may be employed. Sealing assemblies may include ceramic-to-metal seals, glass-to-metal, and/or custom seals using elastomeric seals and/or o-rings. Various alloys, including 310S stainless steel alloy, may be welded to various different steel alloys, including 304 stainless steel, which may be suitable for use with high vacuum tubes and/or flanges for feedthrough sealing. Heat leakage may arise where tubes and wires pass through the inner insulation 24. Additional inner insulation (not shown) may be employed in the immediate area surrounding this leak to compensate for heat leakage, as desired.

As shown in FIG. 7, with ongoing reference to features in FIG. 6, a vacuum-sealed electrical feedthrough 666 may be provided in a feedthrough stub 668 together with a vacuum-sealed gas feedthrough 672. Feedthrough stub 668 may be formed, for example, by a portion of housing 635 that extends through outer insulation 26 and connected to housing 635 at weld joints 688. An electrode 654 (or a plurality of electrodes 654) may extend through electrical feedthrough 666 for connection to controller 650. Electrode 654 may, for example, connect controller 650 with one or more sensors 626 and heaters 604. Vacuum-sealed gas feedthrough 672 may provide a sealed passage through which sealed gas inlet 618 or sealed gas outlet 620 extends for connection to a pump for process gas or a vacuum pump.

Figure 9:
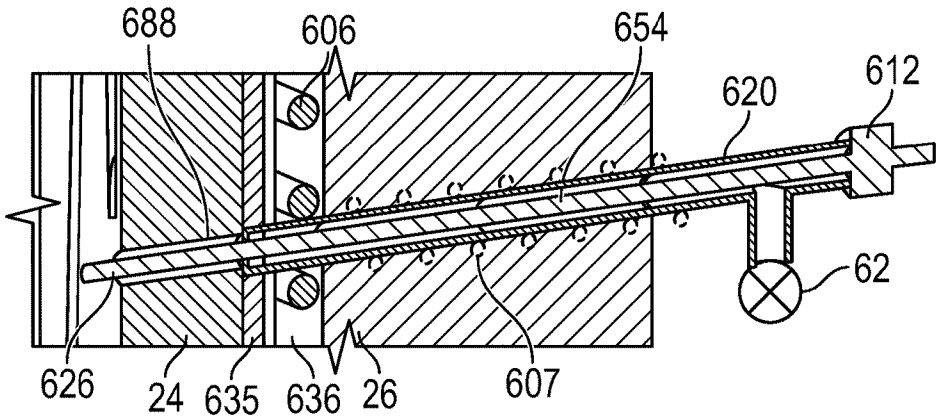
FIG. 9 is a detail view of a sealed outlet.
Figure 8:
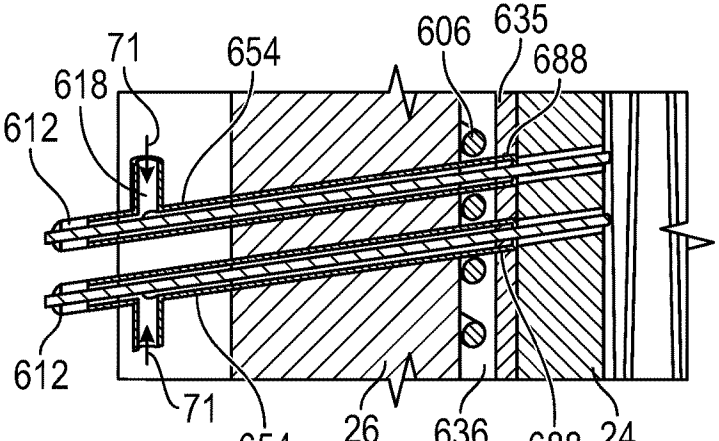
FIG. 8 is a detail view of sealed inlets.

FIGS. 8 and 9 illustrate another exemplary configuration for feedthroughs for electrical and/or gaseous connections. In one aspect, one or more electrodes 654 may be secured within one or more inlets and outlet tubes 618, 620 and electrically isolated from tubes 618 and 620. Electrodes 654 may, as discussed above, be useful for connecting controller 650 to heaters 604 and/or temperature sensor 626. Electrodes 654 and inlets or outlet tubes 618, 620 may also be employed to connect outer heater controller 652 to heaters 606 and/or temperature sensor 702. Inlets and outlet tubes 618, 620 may include ceramic-to-metal electrical feedthroughs 612, for example. Electrodes 654 may be supported coaxially within the tubes to avoid electrical contact and maintain isolation with no need for electrical insulating materials, or the electrodes could alternatively be surrounded by electrically-insulating supports (not shown) extending within inlet tube 618 and outlet tube 620, if desired a long as the insulating material do not excessively impede gas flow through the tubes. Inlets and outlet tubes 618, 620 may include sealed electrical feedthroughs 612 (such as commercially available ceramic to metal electrical feedthrough and/or elastomeric sealed electrical feedthroughs), which may avoid the need to install feedthroughs between feeds 618, 620 and housing 635 (an interface which may reach approximately 1,100 degrees C.), and may be sealed, e.g., by welding, to a wall of chamber 635. Tubes 618, 620 may also extend through vacuum housing wall 32 (see FIG. 6). If desired, hermetic sealing may be employed at the interface between tubes 618, 620 to hermetically seal the tubes with respect to vacuum housing wall 32. In FIG. 8 optional heaters are illustrated along the tube and a hot valve. The purpose of this is to keep the whole tube at 500 C during debind. This can reduce or prevent condensation along the tube during debinding.

Process gas 71 introduced via inlets 618 may impede diffusion and condensation of contaminants that may otherwise tend to diffuse toward the cold end of chamber 635. A flow of gas through outlet tube 620 (e.g., via a vacuum pump connected to tube 620) may impede back diffusion of contaminants that may tend to condense in relatively colder regions as they flow from the hot end or work zone 228.

Figure 11:
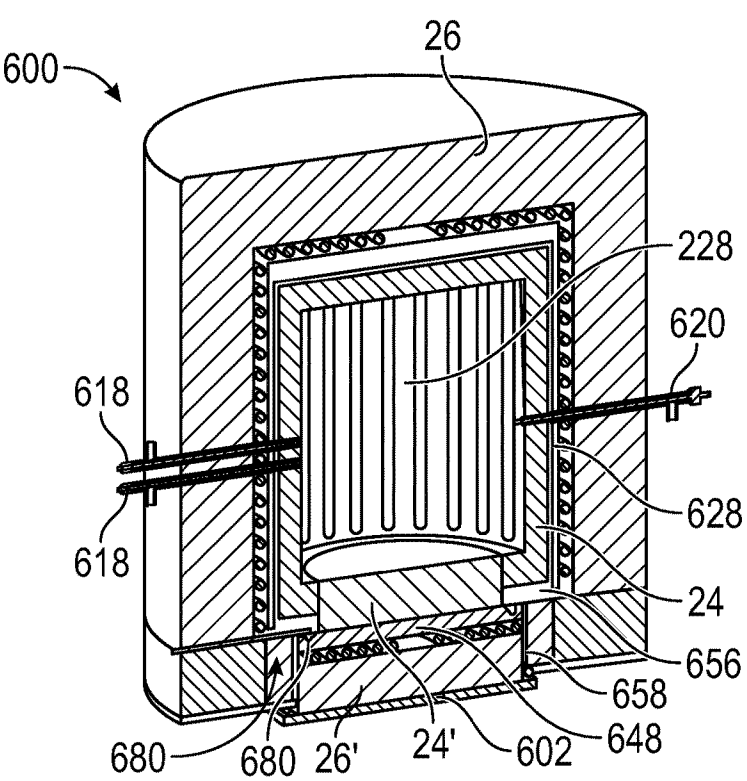
FIG. 11 is a cross-sectional view of the compound furnace of FIG. 10 in a closed position.
Figure 10:
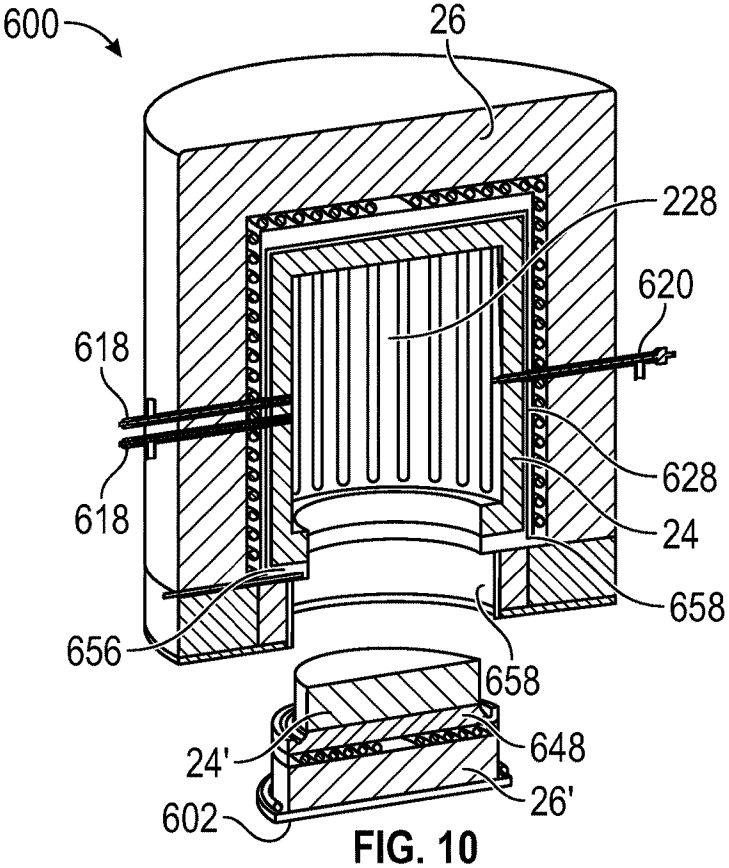
FIG. 10 is a cross-sectional view of a compound furnace having a high temperature seal and a horizontally-extending sweep gas feed tube in an open position.

FIGS. 10-14 illustrate an exemplary configuration of furnace 600 including a high temperature seal 680 that can be operable well above melting temperatures of elastomeric seals and may be used in conjunction with sweep gas 422 to provide for sweep gas "Peclet" sealing and/or isolation between work zone 228 and door 602 of furnace 600 as well as between the work zone and door insulation 26'. FIGS. 10 and 11 illustrate furnace 600 in open and closed positions, respectively. Seal 680 may form inner and outer seals between inside of the sealed chamber and the door insulation and the door itself. In particular, door 602 may include a seal plate 648 that can now be considered as an openable and closable part of the high temperature sealed chamber and includes seal features that facilitates the formation of one or more individual seals between a body seal flange plate 656 of housing 635 and seal plate 648. An optional outer tube or housing 658 may be secured to an opening of furnace 600 that receives door 602. Housing 658 may be made of the same or similar materials as housing 635 and may similarly be formed with a tubular (cylindrical) shape, a rectangular shape, or any other suitable shape. Alternatively plate 648 could be supported by door 602 by other means such as support posts.

Figure 12:
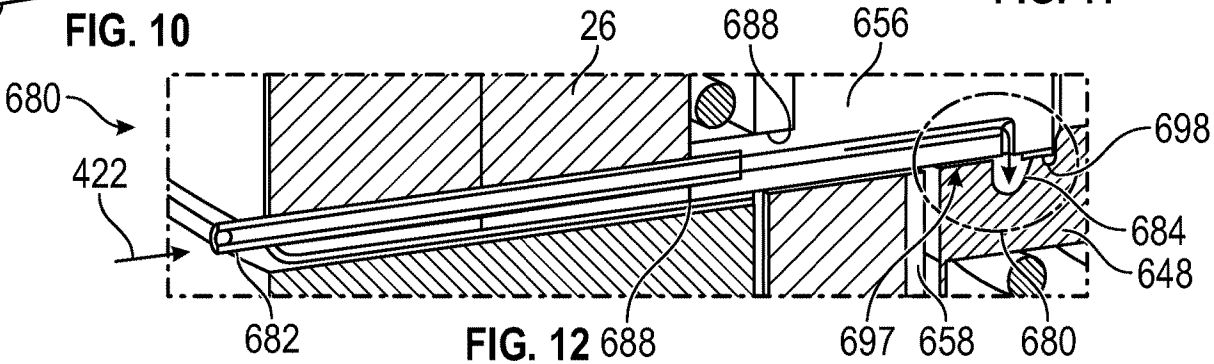
FIG. 12 is a detail view of the seal in the compound furnace of FIGS. 10 and 11.

FIG. 12 is a detail view of the encircled high temperature seal 680 of FIG. 11. Seal 680 may include an approximately horizontally-extending feed tube 682 configured to receive a flow of sweep gas 422. Feed tube 682 may be secured and sealed to flange 656 via one or more weld joints 688 or other suitable mechanisms. The gas flow channel through the bore of Feed tube 682 may continue to extend through body seal plate 656 to provide sweep gas 422 to a circumferentially-extending sweep gas channel 684 formed within door seal plate 648. Although reference is made to a circumferentially-extending sweep gas channel 684 because FIGS. 49 and 50 depict a cylindrical furnace 600, it is understood that furnace 600 may have any suitable shape (e.g., rectangular or square), and, as such, sweep gas channel 684 may have a shape suitable to accommodate the shape of furnace 600. A face of door seal plate 648 may closely-face an opposing face of body seal plate 656 such that channel 684 feeds a Peclet gap seal 697 to provide a Peclet seal as an outer seal as will be described below. An inner seal 698 may include a somewhat leaky high temperature gasket seal, such as graphoil gasket. In the exemplary configuration illustrated in FIGS. 10-12, outer seal 697 may form a Peclet seal in which a flow of sweep gas 422 may appreciably improve the sealing operation of seal 680 as will be discussed in reference to FIG. 14.

Figure 14:
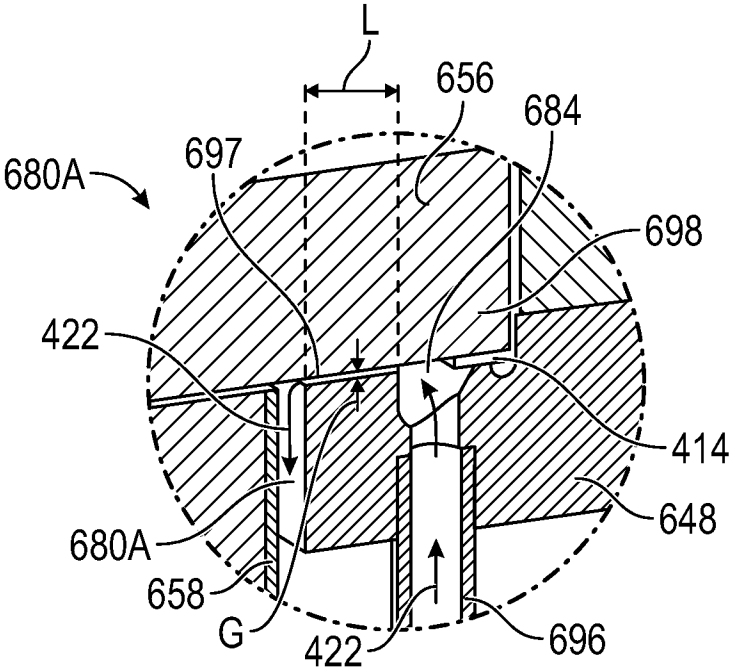
FIG. 14 is a detail view of a high temperature seal in the compound furnace of FIG. 13.
Figure 13:
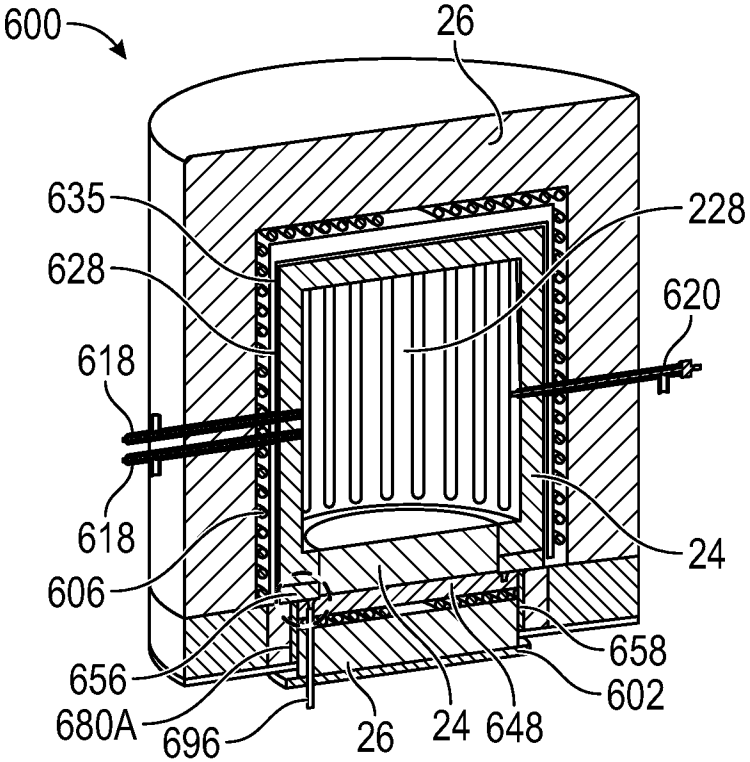
FIG. 13 is a cross-sectional view of compound furnace having a high temperature seal and a vertically-extending sweep gas feed tube.

FIGS. 13 and 14 illustrate an alternate configuration for a seal 680A for sealing work zone 228. Seal 680A may include a vertically-extending feed tube or line 696 that receives sweep gas 422. An outer Peclet seal 697 of main seal 680A may be fed by a channel 684. Sweep gas 422 may enter the channel of outer Peclet seal 697 from feed line 696 via a channel 684, and may inhibit ingress of contamination in a direction toward inner seal 698 by overwhelming diffusion of contamination that would otherwise occur with no sweep gas flow Channel 684 may be formed in other shapes, including square or rectangular shapes, according to the shape of plates 656 and 648. Plate 648 may be integrated within door 602, as shown in FIG. 13, and may extend between inner insulation 24 and outer insulation 26 of door 602.

With ongoing reference to FIGS. 10-13 and with details shown in FIG. 14, sweep gas "Peclet" sealing may be described as follows. An outer seal can be configured by impeding diffusion of contaminants which in turn can be accomplished by way of Peclet sealing (otherwise known as sweep gas sealing) whereby a sweep gas 422 such as Nitrogen or inert Argon can be applied in a downstream direction (from inside the seal—at channel 684—to the outside of the Peclet seal) with sufficient flow rate such that the sweep gas 422 has a velocity that is much greater that the upstream average diffusion velocity of contaminants. In a very loose crudely analogous example a school of fish cannot be expected to swim upstream if the velocity of a river is many times the fastest possible swimming speed of any given fish in the school. A more exact understanding, described immediately below, accounts for diffusion based on approximate theoretical equations that we have proven to be highly accurate and reliable for characterizing Peclet sealing. Peclet sealing can be quantified as follows.

Peclet sealing may be conceptualized as resulting from the flow of a relatively clean, pure sweep gas 422 that is provided with a sufficiently uniform and rapid flow velocity within Peclet channel 697 so as to overwhelm diffusion of contaminants (such as oxygen, moisture and/or hydrocarbons) upstream against the sweep gas flow.

This description of Peclet sealing may be understood and quantified approximately according to a unitless Peclet number $Pe=u\times L/D$, where Pe represents Peclet number, u represents average velocity of sweep gas within a tube or channel, L represents the length of the channel, and D represents the diffusivity of the contamination species (for example Oxygen, moisture and/or hydrocarbons) in the sweep gas. The degree of isolation R is a ratio of concentration contaminant on the upstream end (the clean end) of the Peclet channel divided by the concentration of contaminant on the downstream (contaminated side) and R can be estimated as $R=Exp(-Pe)$. Accordingly, for a given gas flow velocity, the Peclet number and hence the degree of isolation can be increased by any combination of (i) using a thinner and/or longer channel (ie smaller G and/or longer L) (ii) increasing gas flow. We have validated the reliability of this approximation for atmospheric pressure conditions as long as $L>>G$ and we have routinely demonstrated seals as shown in FIG. 14 that provide for R=10E-6 to R=10E-9 using very modest Argon sweep gas rates at atmospheric pressure and varying between 0.01 standard liters per minute (slm) to 2 slm with a channel length L of 0.375 to 1 inch and a channel gap G of 0.005" to 0.030". We have verified that with the Peclet seal providing R<1E-6 is acceptable for the inner seal 414 (for example a graphoil gasket) to be very leaky relatively to typical vacuum seals. For example we routinely measure inner seal leak rates as high as 1 Torr Liter Per second and this can be perfectly acceptable in view of the high degree of isolation described immediately above. Indeed we routinely demonstrate seals using ceramic plates where our seals exhibit R<1E-9 even for operation at 800 C-1400 C with vacuum pressures of less than 100 torr within the sealed chamber and in some cases less than 5 torr and in other cases less than 1 torr. These purity levels of parts per billion have been demonstrated despite the gasket leaking at leak rates up to 1 Torr Liter per Second. Applicants are completely unaware of any prior technology enabling such high isolation relative to a vacuum chamber at such extreme temperatures. In previous Figures with the main seal outside the system in ambient environment it has been noted that elastomeric seals can be used as door seals. However there is no requirement in this regard and it should be understood that the above described hot seal could be effective outside as well as inside the outer insulation.

Figure 15:
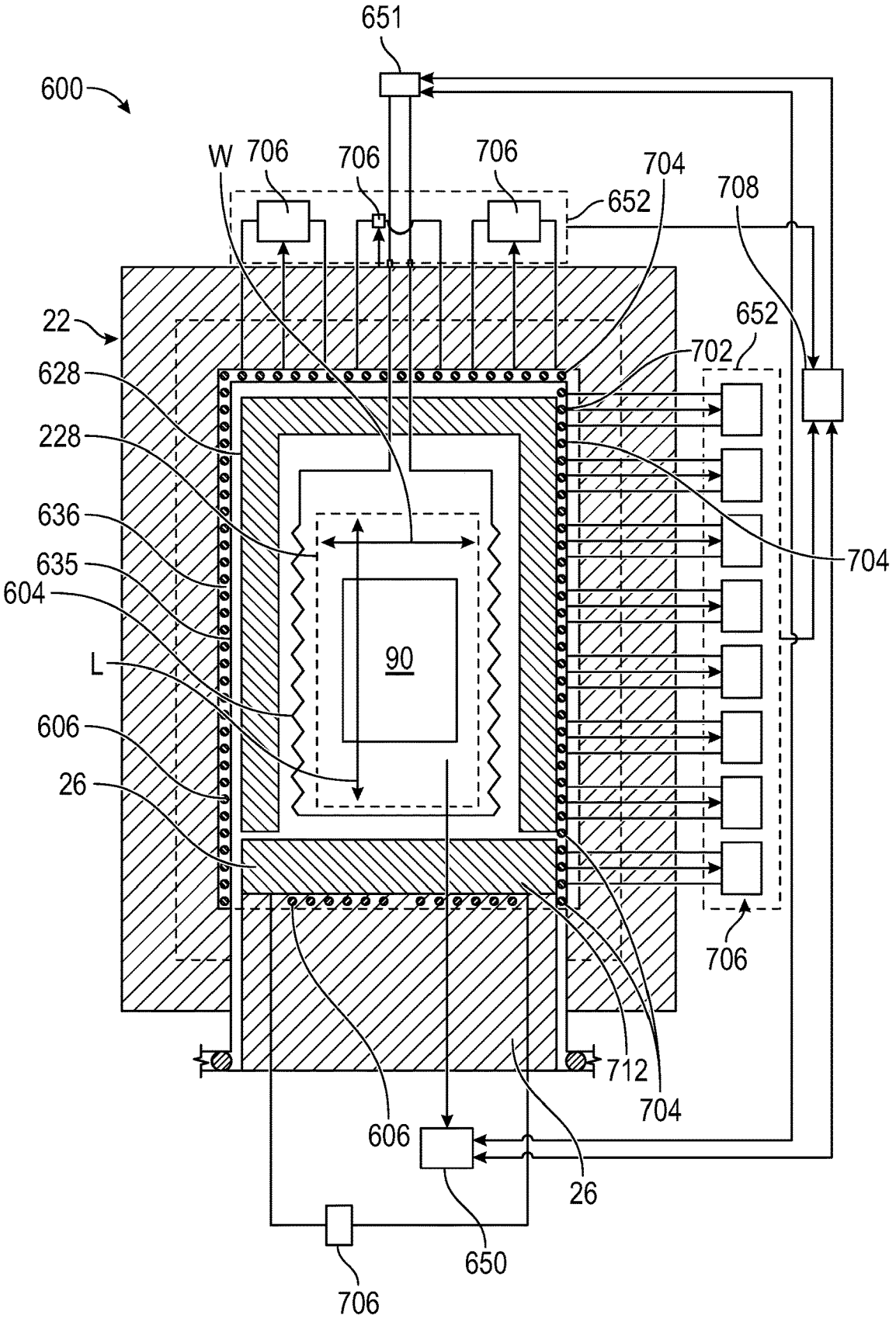
FIG. 15 is a cross-sectional view of a furnace including a plurality of outer heater control modules.

FIG. 15 provides a partially-schematic cross-sectional view of a furnace 600 configured to compensate for imperfect spatial uniformity of an arrangement of insulation 22. Non-uniformity of outer insulation 22 may lead to corresponding thermal non-uniformity, such as formation of hot spots and/or cold spots on the surface of housing 635. Non-uniform heating may be caused by, for example: (i) the presence of thermal leaks through outer insulation 22, including any leaks that may be introduced intentionally (for example, by introducing cooling channels to be described later (ii) variations of K value within outer insulation 22, including variations that may arise due to aging, contamination, or any other imperfections, or (iii) geometrical effects, such as thermal effects of variations in the geometry and/or symmetry of one or more sections or localized regions of outer insulation 22 (for example, where lateral ends vary in comparison to other sections, such as a central region). Leaks may be conceptualized as belonging to one of two categories: (1) intentional leaks, such as cooling channels, and (2) inadvertent leaks, such as cracks and gaps between one or more joined layers of insulation 22 or within a layer of insulation 22.

The exemplary configuration of furnace 600 illustrated in FIG. 15 may mitigate thermal non-uniformity and heat leaks by the use of one or more outer heaters 606, which may be implemented by dividing the outer heaters and controllers into a number of separate, individually-controlled coils—each with it's own associated sensor and control, that surround chamber 628 and/or housing 635. Each coil (or subset of coils) of heaters 606 may be located proximal to an associated housing temperature sensor 702, which may include a thermocouple. In order to more uniformly heat housing 635, it may be advantageous to spatially-vary the distribution of heat generated by heaters 606. Thus, in some aspects, each separate coil 704 of heaters 606 may be associated with a separate outer heater control module 706. In the exemplary configuration illustrated in FIG. 15, each separately-controlled coil 704 includes approximately four loops. However, it will be recognized that any suitable number of loops may be employed to provide coils 704 that respectively heat relatively larger or smaller regions of furnace 600. Additionally, different respective coils 704 may have different lengths.

Each outer heater control module 706 may receive temperature information for a portion of chamber 636 corresponding to one or more coils 704. A system-level controller 708 may receive information and output control signals to each of the outer heater control modules 706. Additionally, system-level controller 708 may receive feedback information from, and provide commands to, work zone power supply 651, and/or work zone controller 650 so that the plurality of control modules 706 may be cooperatively controlled by a central system level control device such as controller 708.

Figure 16:
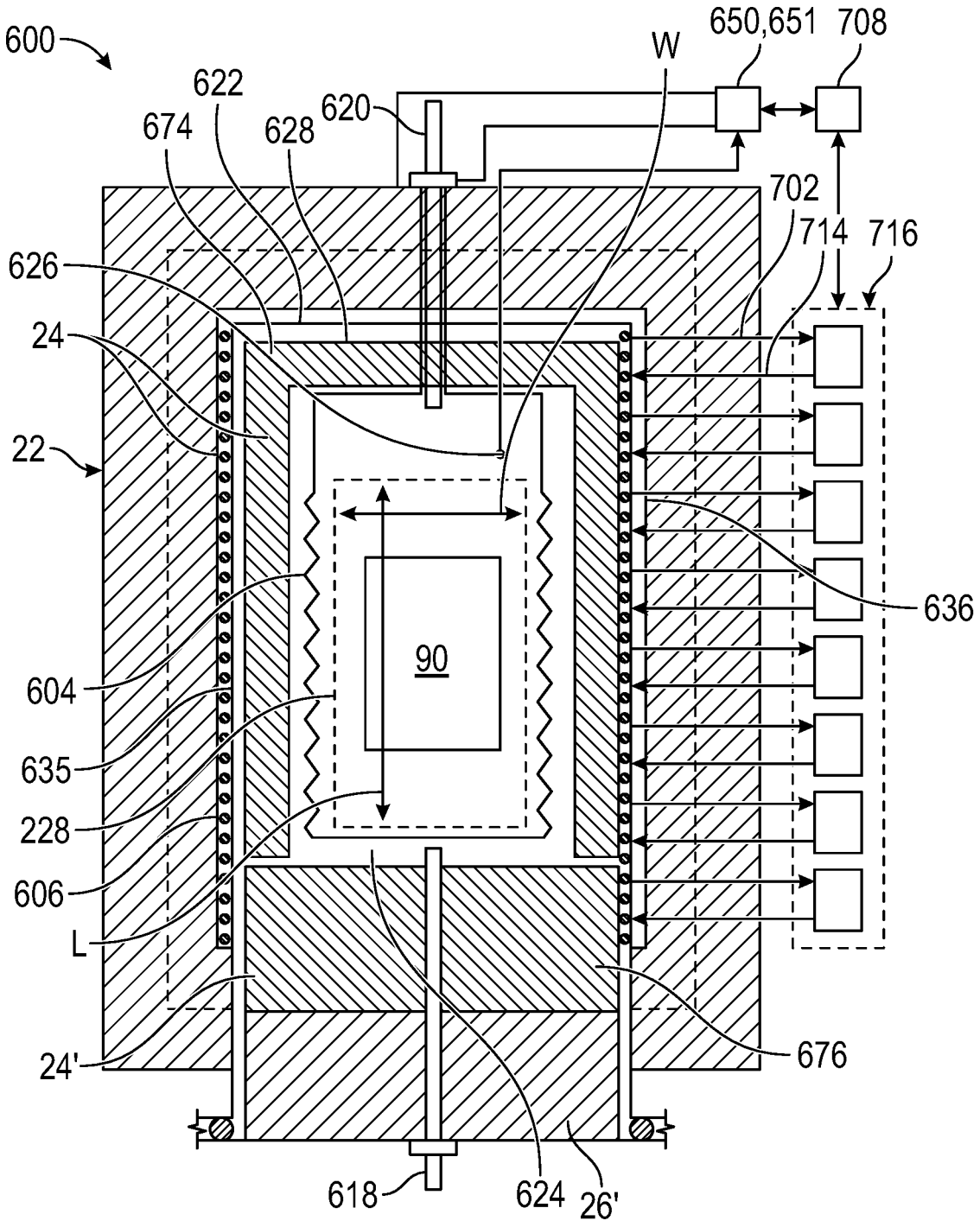
FIG. 16 is a cross-sectional view of a furnace including cooling channels.

FIG. 16 illustrates an exemplary configuration for managing geometric variation at one or both ends of chamber 628, according to aspects of this disclosure. With reference to FIG. 16, an increased thickness of exposed insulation 24 may be present in one or more sections. For example, increased insulation may be present at an end portion 674 of insulation 24 located at closed end 622 of chamber 628, and/or at an end portion 676 of door insulation 24' located at open end 624 of chamber 628. The use of relatively thicker insulation 24 at end portions 674, 676 may facilitate heating of chamber 628 when inner heaters 604 do not include elements facing the surface of a thickened insulation sections (e.g., adjacent end portions 674 and/or 675). As shown in FIG. 16, additional insulation at end portions 674, 675 may eliminate and/or reduce the need for outer heaters 604 facing one or more ends of work zone 228. This configuration may improve performance of the system for heating furnace 600 because, while an increased amount of exposed insulation 24 may be included, this additional insulation may affect only a local area of furnace 600 and not significantly increase overall contamination.

The above-described configurations of furnace 600 depicted in FIGS. 3 and 5-16 may be configured to use outer heaters 606 to maintain chamber 628 at a substantially constant boundary temperature (or within a predetermined temperature range), at least during a portion of a debinding or sintering cycle. This boundary temperature may be at, near, or below a maximum acceptable temperature for the sealed housing, for example 1100 C for a sealed housing composed of 310S alloy.

With ongoing reference to FIG. 16 it is noted that controllers 652 and temperature sensors 702 have been added with controllable air blowers that can be controlled responsive to temperature sensors 702 and the heater controls are omitted from the figure to minimize clutter of the drawing. This represents an embodiment that allows for control of sealed chamber 635 by way of controlled heating (using outer heaters 606) in combination with controlled cooling using blowers 716. In at least some embodiments the controllable cooling may be generated by a plurality of small air pumps or blowers 716 to help facilitate maintenance of a predetermined temperature or range of temperatures of housing 635 by providing air to chamber 636. Blowers 716 may be included instead of, or in addition to, locally-thicker regions of insulation 24 (e.g., end portion 674, 675).

Furnace 600 may, with respect to a particular holding power (for example 4 kW), tend to experience overheating of housing 635 when blowers 716 are deactivated. In order to avoid such overheating of housing 635 at steady-state sintering power, a closed-loop air cooling system may include smaller blowers 716, cooling channels 714 for providing cooling air from blowers 716, a control module for each blower 716 (or subset of blowers) that may be integrated into blowers 716 or provided separately, and chamber temperature sensors 702. Blowers 716 may controllably circulate cooling air to maintain the temperature of secondary chamber 636 and/or housing 635 approximately constant or within a pre-determined temperature range. The design of furnace 600 may take fail-safe considerations into account to ensure that, in the event of a power failure, or other failure of the cooling system, the thermal mass in work zone 228 may not cause thermal damage, especially to the temperature resistant housing 635. Options for air cooling include, but are not limited to, relatively small, low-cost displacement pumps, such as piston pumps or diaphragm pumps, small squirrel cage fans, or one or more other suitable mechanisms. In exemplary configurations, cooling requirements may reach approximately several hundred watts or approximately 1,000 watts.

Figure 17:
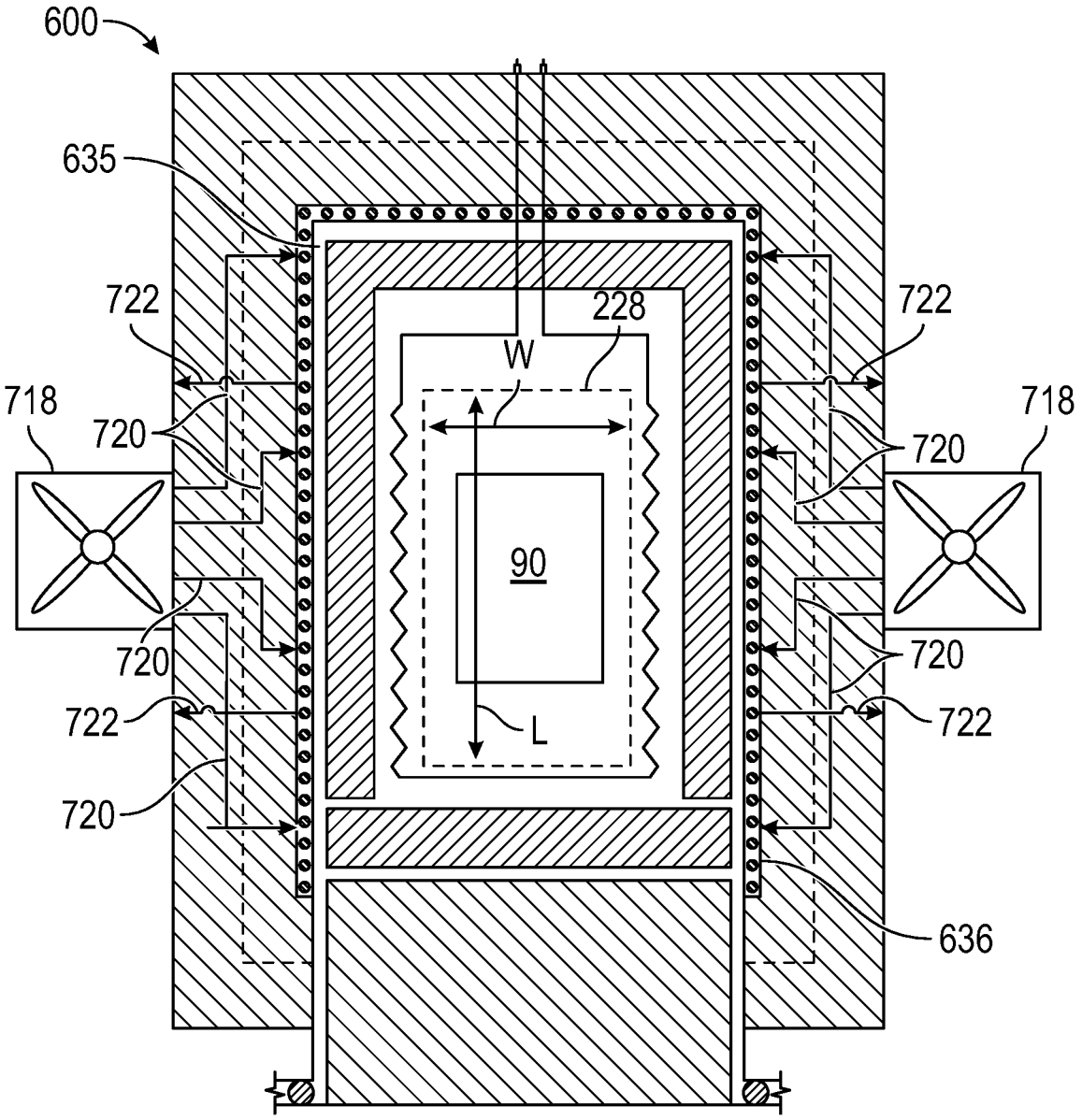
FIG. 17 is a cross-sectional view of a furnace including a rapid cooling mechanism.

FIG. 17 illustrates another exemplary approach for cooling housing 635 via chamber 636. In the embodiment illustrated in FIG. 17, a rapid forced air cooling system for furnace 600 may include one or more air blowers 718 configured to drive relatively large quantities of air through cooling channels. For example, blowers 718 may be configured to drive air through air inlet channels 720 such that this air exhausts via air outlet channels 722. One or more blowers 718 may be used to produce a total of approximately 10 cubic feet per minute (CFM) to approximately 100 CFM of air circulation for relatively rapid cooling. While air inlet and outlet channels 720, 722 may tend to create thermal leaks, this leakage may occur within acceptable ranges. An exemplary rapid cooling system may provide a total of approximately 50 CFM of air displacement of cooling air, a total cross-sectional inlet surface area of approximately three square inches, and include four one-inch tubes for channels 720. While four inlet tubes or channels 720 and two outlet tubes or channels 722A are illustrated for each blower 718 in FIG. 17, a significantly larger number of tubes with smaller surface areas may be used for increased uniformity, or fewer numbers of tubes may be used. The tubes employed for channels 720 and 722 may be ceramic tubes, such as, for example, alumina, which may help to prevent wear and tear on insulation 22 due to airflow. Although the inlets and outlets are referred to herein as tubes, it is understood that the inlets and outlets may have any suitable cross-sectional shape and are not limited to circular. Smaller tubes may result in lower thermal leakage and may be used in conjunction with blowers 718 that are capable of an output that overcomes the resulting flow impedance from the use of smaller tubes. Suitable blowers for such configurations may include a GAST R3105-12 blower (e.g., a blower that may be used with septic tanks). If desired, air-cooling configurations of furnace 600 may include thick and/or excess insulation, as described above in reference to FIG. 16. However, if desired, more uniform thickness of insulation 24 may be employed adjacent to, or inward of, chamber 636 with the use of additional cooling channels.

While a plurality of blowers 716, 718 are illustrated in FIGS. 16 and 17, in at least some embodiments, a single blower may be employed. For example, a single blower may be configured to provide different amounts of cooling to different portions or sections of chamber 636, in a controlled manner. For example, a single blower may include a plurality of individual throttle valves distributed through various channels 720 and/or 722. In general, rapid cooling may be compatible with any of the furnace configurations described herein, including furnace 600 FIG. 16, in which the cooling channels 714 may be arranged to serve two functions: modestly controlling cooling during sintering, as well as more aggressive rapid cooling (e.g., once a sintering cycle is complete).

Figure 18:
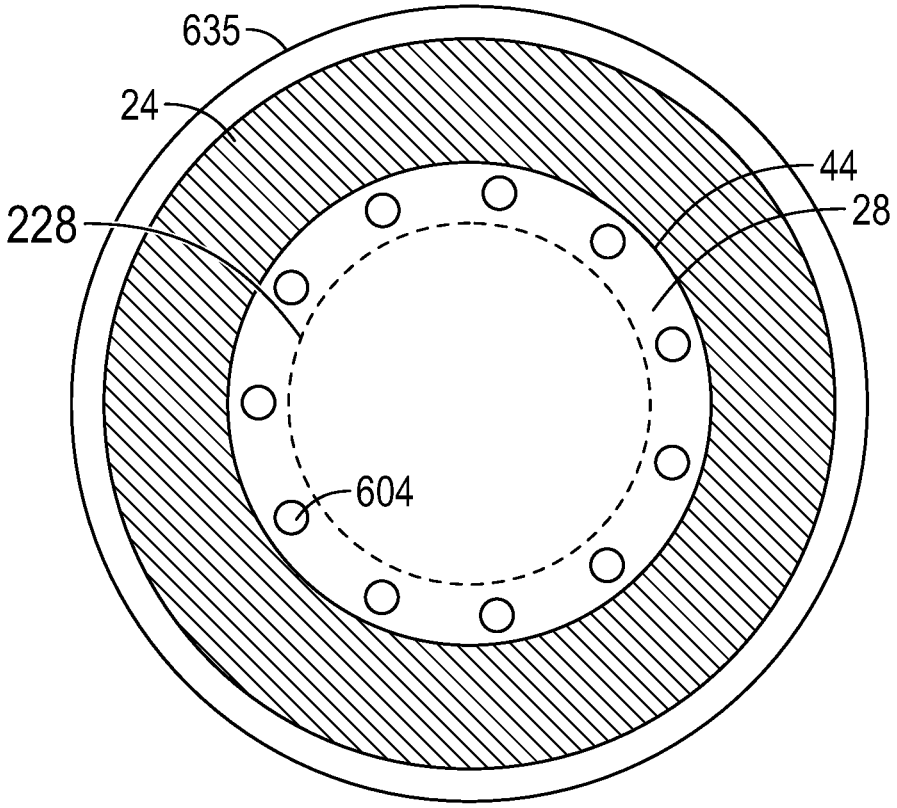
FIG. 18 is a cross-sectional view illustrating an exemplary configuration for providing housing, insulation, and furnace heaters. of a compound furnace.

FIG. 18 illustrates an exemplary cross-sectional shape of sealed housing 635, inner insulation 24, inner heaters 604, and work zone 228 contained by hot face 44. In one aspect, insulation 24 may be formed of a graphite-containing inner insulation. Exemplary design configurations, examples of which are presented in Table 1, may be useful for various furnaces 600 that employ graphite insulation, such as Nippon fiber felt that exhibits conductivity of less than approximately 0.5 W/mK at 1,400 degrees C. Each row of the table below shows designs for a range of work zone (the space that parts occupy) diameters, and each column is for increasing housing temperature.

TABLE 1

| Work zone (inches) (e.g., dimensions of work zone 228) | Hot zone (inches) (e.g., dimensions of interior surface of insulation 24) | Housing 635 outer diameter (inches) | Insulation 24 for chamber temperature of 900 degrees C. (mm) | Insulation 24 for chamber temperature of 1,100 degrees C. (mm) | Insulation 24 for chamber temperature of 1,000 degrees C. (mm) | Insulation 24 for chamber temperature of 1,200 degrees C. (mm) |
|---|---|---|---|---|---|---|
| 6 diameter × 12 length | 8 diameter × 16 length | 10.5 | 16 | 13 | 9 | 5 |
| 8 diameter × 12 length | 10 diameter × 16 length | 13.75 | 24 | 20 | 15 | 9 |
| 10 diameter × 12 length | 12 diameter × 16 length | 15.75 | 31 | 25 | 19 | 13 |

The values shown in Table 1 may correspond to a thermal conductance of 0.5 W/mK (e.g., corresponding to graphite insulation) at 1,400 degrees C., 3 kW of holding pattern at steady-state, and may assume that insulation 24 is formed as a uniform slab of material with no variation in thermal conductivity. Exemplary equations for determining thickness of insulation 24 include: Thickness=ΔT×Conductance×Area/Power; or Thickness=[1,400−Housing temp]×Conductance×Area/Power. In general, thermal conductivity may tend to drop rapidly with a reduction in temperature dropping from approximately 0.5 W/mK at 1,400 degrees C. to approximately 0.05 W/mK at 200 degrees C. If desired, thinner layers of insulation may be used.

It is evident from the above table that For a particular sintering temperature, such as 1,400 degrees C., higher permissible temperatures of housing 635 may allow for the use of progressively thinner insulation 24 and, thus, may provide increasingly cleaner atmospheres during sintering. It is recognized that reducing the margin or difference between the maximum use temperature of housing 635 and the actual maximum steady state operating temperature of the housing 635 may increase cleanliness and atmospheric purity by (i) facilitating the use of less (or thinner) insulation; and (ii) increasing the temperature of insulation 22 during thermal processing, in particular during the beginning stages of a sintering process during which the temperature within work zone 228 may be increasing prior to reaching steady state holding temperature and/or maximum peak temperature. Outer heaters 606 may be utilized early in the sintering cycle to facilitate the increase in temperature. In exemplary processing, excellent atmospheric cleanliness may be achieved by one or more of: (1) using outer heaters 606 in addition to the inner heaters during debinding to achieve debinding temperature(s) in work zone 228 such that heat from the outer heater keeps the outside at the same or even higher temperature as the inside hot face of the inner insulation. For example, as the inner heaters bring the inner hot face to debinding temperature (for example 500 C) outer heaters 606 may heat the outside of the inner insulation 24 and to approximately the same or possibly even higher temperature. This processing with outer heaters 606 will generally tend to prevent or at least inhibit condensation within exposed insulation 24 and on housing 635 and/or chamber 636 by elevating the entire insulation 22 and housing 635 to approximately the same temperature as the temperature of work zone 228 during debinding; (2) increasing the power applied to outer heaters 606 to raise the temperature of housing 635 to approximately the maximum use temperature (e.g., about 1,100 degrees C. for a 310S stainless steel housing 635, which may initiate and progress the ramp up to sintering temperature until the inner heaters 604 are powered to maintain the ramp rate); (3) activating inner heaters 604 when the temperature of housing 635 approaches a maximum acceptable temperature to drive the temperature of work zone 228 towards a predetermined sintering temperature (simultaneously, a secondary feedback control may be activated and operated as described above so that outer heaters 604 do not overheat the housing 635 beyond its maximum acceptable temperature); (4) optionally, employing cooling channels and a cooling system as part of the feedback control to avoid overheating of housing 635; (5) de-activating heaters 604 and 606 at the conclusion of sintering, and activating rapid cooling systems to rapidly cool work zone 228. This process is illustrated in FIG. 60. It is noted that there are many variations that could be employed but the basic idea is that during the ramp up to debinding, and during debinding, the inner and outer heater controllers cooperative active inner and out heaters to heat the inner insulation from the outside a well as the inside during debinding. After debinding the outer heater power can be progressively reduced until it is only serving to help maintain the desired steady state sintering temperature for sealed chamber 635.

At least some embodiments may include refractory metal materials in insulation 24 as a layered stack of thermal reflectors arranged such that emission from each plate is, to some extent, reflected by the next outer layer, with the power between each layer being a function of emissivity and temperature difference. It is noted that the manufacturing and assembly of such insulation 24 may employ support mechanisms that may bring a degree of thermal conductivity. Nevertheless, it may be possible to take the thermal conductivity of such support mechanisms into account for furnace 600. Exemplary design guidelines and assumptions useful for inclusion of refractory metal materials may include: an effective emissivity of approximately 0.3 for the refractory layers. In particular, emissivity of clean molybdenum may be below 0.25 at a temperature below 1,500 degrees C. (taking into account that emissivity generally rises going from relatively low (100 degrees C.) to higher (1,400 degrees C.) temperatures. Emissivity of steels may be relatively high, e.g., at 1,000 degrees C., the emissivity may be about 0.8. It may be possible to compensate for such emissivity by adding one more refractory layer(s).

Heat flow from one layer to the other may be related to, e.g., proportional to, emissivity. Heat flow through different insulation materials may be approximately the same (e.g., emissivity through metal shields and through nickel isolated insulation may be approximately the same). The design considerations described above may also be applied to graphite materials for insulation 24, (taking into account that it may be difficult to assign a conductivity value). In some embodiments that include graphite materials for insulation 22, it may be beneficial to perform an iterative calculation to determine the number of required layers associated with: (i) a given sintering temperature, (ii) an assumed steady-state power, and (iii) an assumed maximum chamber temperature.

TABLE 2

| Work zone (inches) (e.g., dimensions of work zone 228) | Hot zone (inches) (e.g., dimensions of interior surface of insulation 24) | Baseline number of layers (N) and inner diameter of housing 635 (ID) | Number of layers (N) to achieve temp. < 900 degrees C. | Number of layers to achieve temp. < 1,100 degrees C. | Number of layers to achieve temp. < 1,000 degrees C. | Number of layers to achieve temp. < 1,200 degrees C. |
|---|---|---|---|---|---|---|
| 6 dia. × 12 length | 8 dia. × 16 length | N = 23 ID = 10.6 | N = 15 ID = 9.6 | N = 13 ID = 9.4 | N = 11 ID = 9.2 | N = 8 ID = 8.9 |
| 8 dia. × 12 length | 10 dia. × 16 length | N = 30 ID = 13.48 | N = 19 ID = 11.7 | N = 17 ID = 11.4 | N = 14 ID = 10.8 | N = 10 ID = 11.2 |
| 10 dia. × 12 length | 12 dia. × 16 length | N = 38 ID = 14.3 | N = 24 ID = 14.76 | N = 20 ID = 14.3 | N = 16 ID = 13.8 | N = 12 ID = 13.3 |

Table 2 provides a summary of exemplary embodiments corresponding to: a 3 kW steady-state holding power, 6 in., 8 in., and 10 in. diameter work zones 228, 12 in. long work zones 228, and assuming atmospheric pressure. Each layer may be assumed to exhibit emissivity of approximately 0.3 for the layers and approximately 0.8 for the wall of temperature resistant housing 635. For purposes of comparison, an exemplary baseline design is included in the third column of Table 2 above. This baseline design assumes an outer housing temperature corresponding to 3 kW, which may be expected to match, within 100 degrees C., the outer temperature that may be expected for 3 kW heat dissipation. In accordance with one or more aspects of this disclosure, and similar to Table 1, the higher the temperature of chamber 628, the lesser the amount of inner insulation 24 may be required. It is noted that each row corresponds to a given work zone, and each entry includes an exemplary estimate of chamber tube diameter (diameter of housing 635).

Various considerations may be taken into account with respect to the configuration of inner exposed insulation 24 for furnace 600, as described above. Similarly, outer isolated insulation 26 may be configured based on one or more design considerations that affect operation of furnace 600. In some furnace designs, an initial design step may include selection of a type of insulation based on a particular manufacturer and/or type of insulation. Once this first design is established, the design may be improved, e.g., by reducing insulation thickness with the inclusion of one or more grades of insulation, and/or dense high-grade materials toward the hot face and microporous materials on the outer layers. For some furnaces 600 having outer insulation and outer housing temperatures of approximately 1,250 degrees C. or less, ceramic fiber materials, such as Morgan Thermal Cerablanket, which may have maximum use temperatures of approximately 1,250 degrees C. and a densities of approximately 128 kg/m$^3$, may be considered for use as outer insulation. An appropriate outer insulation thickness may be determined based on solely hot zone 228 temperature, under the assumption of approximately 100 degrees C. outer temperature (e.g., at wall 32), and a passive convective heat loading of roughly 100 W/m$^2$. In this approach to furnace design, the heat load for conduction through the insulation may escape at roughly 750 w/m$^2$ (not to be conflated with heat load requirements for overcoming leakage and for achieving desired ramp rates). In at least some furnaces, in particular those requiring high mass loads and high ramp rates, the maximum heater power may be significantly higher than the steady-state heat power conducting through the insulation.

Table 3 below lists exemplary insulation thicknesses of an exemplary insulation material (Morgan Cerablanket) for various temperatures of housing 635. Other suitable products, which may provide relatively low-cost solutions (in comparison to relatively high grade graphite), may be used instead of, or in addition to, Morgan Cerablanket.

TABLE 3

| Tube (e.g., housing 635) temp | Insulation 24 thickness |
|---|---|
| 900 C. | 5 in. |
| 1000 C. | 6.25 in. |
| 1100 C. | 8 in. |
| 1200 C. | 10 in. |

Table 4 includes exemplary amounts of heat convection from the outside of outer insulation 26, for different tube sizes (sizes of housing 635) and thicknesses of outer insulation 26. For the values of Table 4, it is assumed that the outside of the insulation pack in steady-state is approximately 100 degrees C.

TABLE 4

| Temperature | Insulation 26 thickness | 10 in. housing | 11 in. housing | 12 in. housing | 13 in. housing | 14 in. housing | 15 in. housing | 16 in. housing |
|---|---|---|---|---|---|---|---|---|
| 900 C. | 5 in. | 942 | 997 | 1,053 | 1,109 | 1,167 | 1,225 | 1,284 |
| 1,000 C. | 6.25 in. | 1,166 | 1,227 | 1,289 | 1,351 | 1,414 | 1,478 | 1,542 |
| 1,100 C. | 8 in. | 1,520 | 1,589 | 1,659 | 1,729 | 1,800 | 1,872 | 1,944 |
| 1,200 C. | 10 in. | 1,982 | 2,060 | 2,139 | 2,218 | 2,298 | 2,379 | 2,461 |

Table 4 may illustrate that one or more packs of outer insulation 26 may dissipate less than the 3 kW of power, which may be desired for maximum steady-state holding power. Accordingly, for exemplary configurations of furnace 600 described herein, there may be adequate margin to facilitate the inclusion of heat leaks, such as air cooling channels 616, without exceeding power requirements for furnace 600. In cases in which channels 616 may introduce excessive heat loss, it may be possible to include channels 616 in combination with relatively thicker outer insulation 26 to compensate for the increased heat loss. Additionally, thinner insulation may be desired in some applications (e.g., applications in which it is desired that furnace 600 have a smaller footprint). This may be achieved by employing more complex designs having different types of insulation for progressively cooler outer layers. For example, suitable microporous insulation materials (e.g., microporous insulation manufactured by Promat) may be employed. Such microporous insulation materials may have a maximum use temp of approximately 1,000 degrees C. and a relatively high R value as compared to typical ceramic blanket materials.

Figure 19:
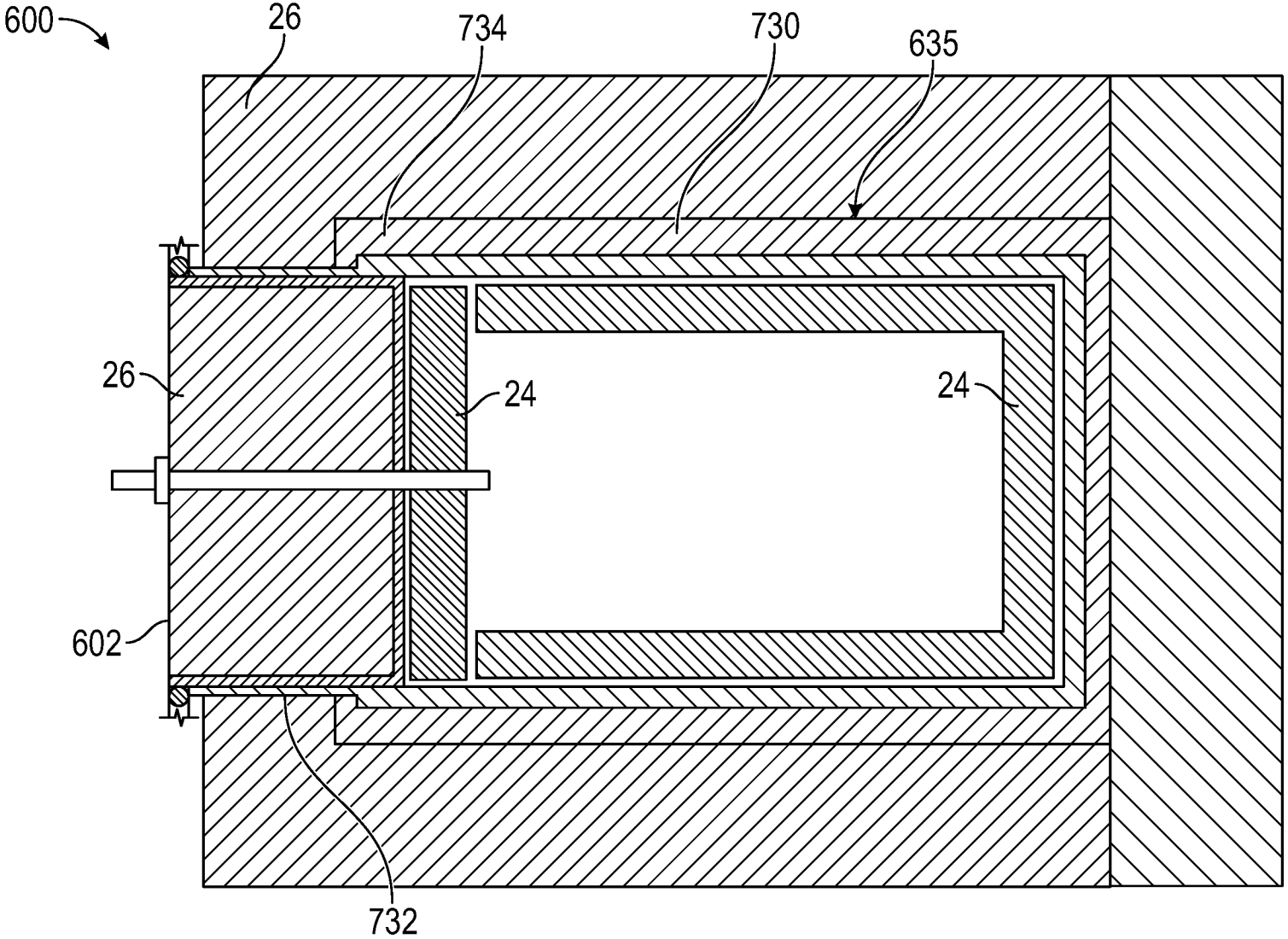
FIG. 19 is a cross-sectional view illustrating an alternative main body of a furnace.

Each configuration of furnace 600, like furnaces 100 and 400, may be operable in a vacuum (e.g., a vacuum applied via outlet 620). Vacuum operation may be facilitated by use of walls having thickness thicker than approximately 0.125 inches. High temperature alloys, such as 310S, may exhibit some degree of softening and/or creep at elevated temperatures, such as 1,100 C. Therefore, in some embodiments, as is illustrated in FIG. 19, the softening and/or creep may be overcome by using a thicker tube for the main body of the furnace (e.g., housing 635). For example, a main body 730 of furnace 600 may be include a housing 635 formed with relatively thick walls 734. However, heat load through sections of housing 635 that extend through insulation 22 may tend to increase linearly with thickness. Thus, it may be advantageous to use a relatively thinner tube for a portion of housing 635 that extends through the insulation toward the main opening. For example, thin walls 732 may extend through insulation 26 and the opening which receives door 602. As the temperature tends to drop in an approximately linear manner from the main body 730 with respect to door 602, there may be only a short (e.g., between approximately 2 in. and approximately 4 in.) section of the relatively thin wall 732 that is subjected to both high heat and high temperature, and the thicker walls 734 may continue to provide support along this portion.

Figure 20:
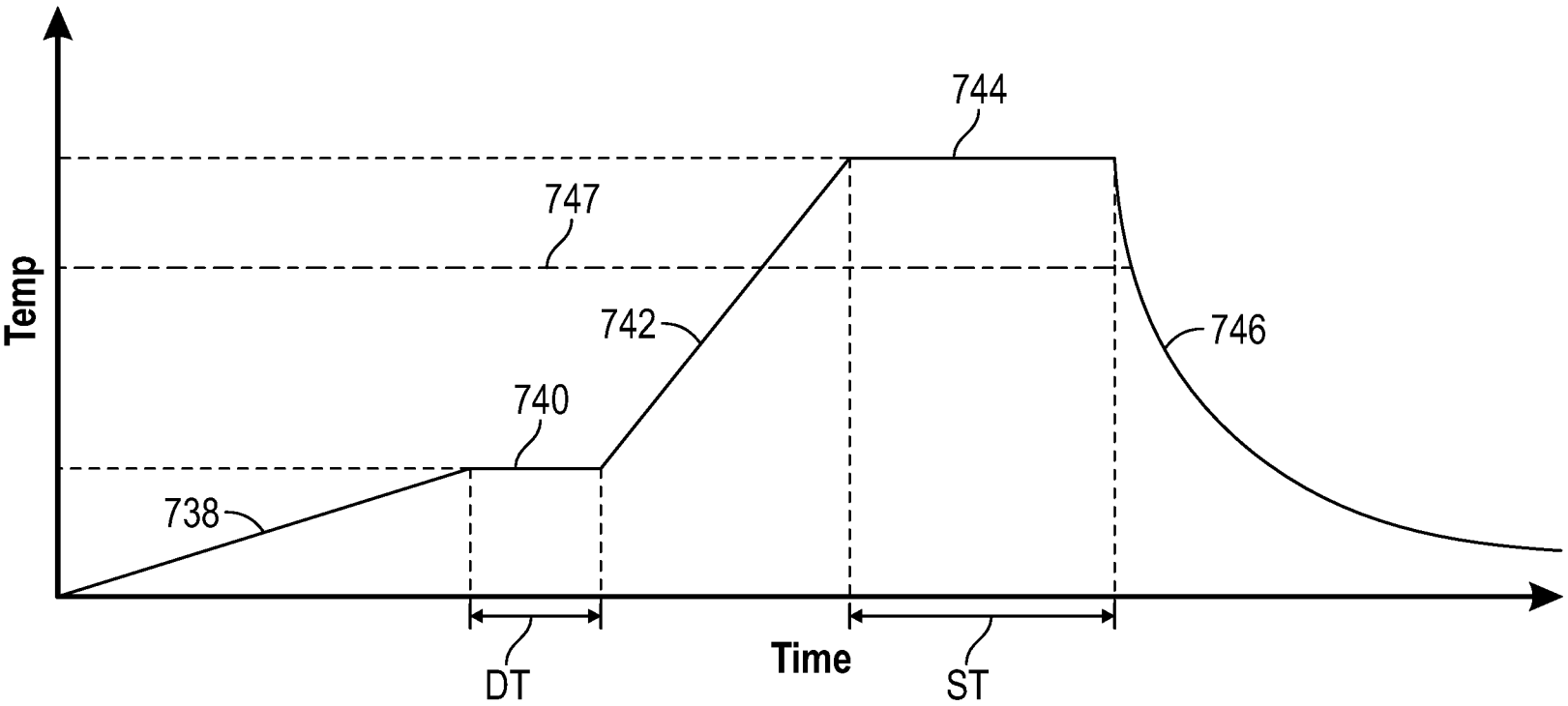
FIG. 20 is a chart illustrating exemplary thermal processing that may be performed by furnaces of the present disclose.

FIG. 20 is a chart illustrating an exemplary temperature cycle within hot zone 28 of embodiment furnaces during thermal processing. While the thermal processing represented in FIG. 20 includes both debinding and sintering portions, debinding or sintering may be performed separately. At a beginning of thermal processing, the temperature may be relatively slowly elevated during ramp up, e.g., debinding ramp up 738. Debinding ramp up 738 may occur over a period of time of approximately eight hours, but may be shorter or longer depending on factors including: the size, number, and shape of parts 90, the type of binder present in parts 90, and a size of the powder particles that form each part 90. The rate at which temperature increases during ramp up 738 may increase or decrease accordingly.

At the end of ramp up 738, the temperature within hot zone 28 may reach approximately 500 degrees C. Once this temperature is reached, the temperature within hot zone 28 may be held approximately constant during a debinding dwell period 740 that occurs for a debinding dwell time DT. This dwell time DT may extend for approximately one hour, but may be shorter or longer based on one or more of the above-described factors.

At the conclusion of dwell time DT, the temperature within hot zone 28 may again begin to ramp up during a sintering ramp up 742. As can be seen in FIG. 20, the temperature within hot zone 28 may increase at a faster rate during sintering ramp up 742 as compared to debinding ramp up 738. The duration and rate of temperature increase during ramp up 738 may also be altered according to one or more of the above-described factors associated with parts 90. Once a predetermined sintering temperature has been reached at the end of sintering ramp up 742, this sintering temperature may be maintained approximately constant or in a steady-state condition, for sintering timing ST. ST may extend for approximately three hours, but may be longer or shorter for the reasons described above.

At the conclusion of sintering dwell time 744, a cooling period 746 may occur. If desired, one or more post-sintering heat treatments may be performed on parts 90 in the same furnace, or in another furnace.

The inner heaters 604 and outer heaters 606 can be operated in conjunction. In an exemplary embodiment, during the debinding ramp 738 and debinding dwell 740 inner heaters 604 and outer heaters 606 can have the same or similar temperature. During sintering ramp up 742 the outer heaters can have the same or lower temperature as the inner heaters. Temperature line 747 represents the maximum service temperature 747 for the sealed housing 635. During the portion of the sintering ramp up 742, the sintering dwell time 744, and the sintering ramp down 748 the outer heaters 606 are not raised above the maximum service temperature 747, while the inner heaters 604 can be raised accordingly as described above to accomplish sintering in the work zone.

What is claimed is:

1. A compound debinding and sintering furnace with controlled contamination of debinding and sintering parts, comprising:

an outer insulation layer;

an inner insulation layer disposed within the outer insulation layer and having an internal hot face surrounding a work zone;

a sealed housing surrounding the inner insulation layer and composed of a refractory material capable of withstanding a service temperature, the service temperature being greater than a debinding temperature that is less than 1000° C., and less than a sintering temperature that is greater than 1250° C.;

an outer heater system configured to heat at least a portion of the sealed housing and externally heat the inner insulation layer (i) in conjunction with an inner heater system, heat the work zone to the debinding temperature and (ii) inhibit condensation of a binder within and upon the inner insulation layer during a debinding process; and wherein the inner heater system is configured to internally heat the inner insulation and contribute a majority of heating to heat the work zone to the sintering temperature during a sintering process;

at least one gas feedline configured to deliver process gas to the work zone; and at least one vacuum line configured to apply a vacuum to an interior of the sealed housing;

a first gas feedthrough through which the gas feedline traverses the outer insulation layer from an outside cold end, outside the outer insulation layer, to an open hot end that is inside the outer insulation layer and is sealed with respect to the sealed housing;

wherein the cold end includes (i) an inlet for injecting process gas through the gas feedline to an interior of the sealed housing and (ii) an electrical feedthrough sealed to the gas feedline and to an electrode, wherein the electrode is electrically isolated from the gas feedline and extends within the gas feedline from the outside cold end to the open hot end.

2. The compound debinding and sintering furnace of claim 1, further comprising:

a housing door operable as an openable and closeable portion of the sealed housing;

an outer door insulation that serves as a portion of the outer insulation layer and an inner door insulation that serves as a portion of the inner insulation layer, wherein the outer door insulation is disposed between the housing door and the inner door insulation;

a high-temperature seal arrangement disposed between the outer door insulation and the inner door insulation and configured for providing gaseous isolation therebetween, and the high temperature seal arrangement includes an inner seal and an outer seal in gaseous communication with a gas channel disposed between the inner seal and outer seal; and a gas feed configured to deliver a sweep gas to the gas channel such that the sweep gas transits through the outer seal to inhibit ingress of gaseous contaminants from the outer seal to the inner seal.

3. The compound debinding and sintering furnace of claim 1 wherein the electrode is electrically connected to one of (i) the inner heater system for providing electrical power thereto and (ii) a temperature sensor for monitoring a temperature within the work zone.

4. The compound debinding and sintering furnace of claim 1 further comprising a second gas feedthrough through which the vacuum line traverses the outer insulation layer from the outside cold end to the open hot end.

5. The compound debinding and sintering furnace of claim 4 wherein the electrical conductor is electrically connected to one of (i) the inner heater for providing electrical power thereto and (ii) a temperature sensor for monitoring temperature within the work zone.

6. The compound debinding and sintering furnace of claim 1 wherein the outer insulation layer includes a first insulation material that can repeatedly withstand heating by the outer heaters to a maximum temperature that is greater than the debinding temperature, and less than the sintering temperature and the inner insulation layer includes a second insulation material, different from the first insulation material, that can repeatedly withstand sintering temperatures that are greater than 1250° C.

7. The compound debinding and sintering furnace of claim 1 further comprising at least one cooling channel traversing through the outer insulation layer.

8. A compound debinding and sintering furnace with controlled contamination, comprising:

an outer insulation at least partially enclosing a sealed housing;

an inner insulation disposed within the sealed housing;

an inner heater system including at least one inner heater and disposed within the sealed housing and configured to heat a work zone an outer heater system including at least one outer heater;

at least one controller configured to operate the inner heater system and outer heater system, cooperatively with one another, to heat the work zone to a sintering temperature of at least 1250° C.;

wherein the outer heater system is configured to heat the inner insulation layer from outside the sealed housing to a temperature at which contaminants outgassed from a part, heated to a debind temperature, are inhibited from condensing in the inner insulation layer; and a plate including:

an inner seal, an outer seal, and a gas channel, wherein the outer seal is in gaseous communication with the gas channel disposed between the inner seal and the outer seal, and a feed configured to deliver a sweep gas to between the inner seal and the outer seal such that the sweep gas transits through the outer seal.

9. The compound debinding and sintering furnace of claim 8 further comprising:

at least one gas feedline configured to deliver process gas to the work zone; and at least one vacuum line configured to apply a vacuum to an interior of the sealed housing.

10. The compound debinding and sintering furnace of claim 8 further comprising an electrical feedthrough traversing the outer insulation layer from outside the insulation to the sealed housing.

11. The compound debinding and sintering furnace of claim 8 wherein the sealed housing includes a feedthrough stub extending from the sealed housing to outside the outer insulation layer.

12. The compound debinding and sintering furnace of claim 11 further comprising a heater system configured to heat an interior of the feedthrough stub at least during debinding to inhibit condensation of contaminants therein.

13. The compound debinding and sintering furnace of claim 10 further comprising:

an electrode connecting at least one of a heater and a temperature sensor disposed in the sealed housing to a controller disposed outside the outer insulation layer; and wherein the electrode traverses the outer insulation layer via the feedthrough.

14. The compound debinding and sintering furnace of claim 8 wherein the outer insulation layer is formed from a first material capable of withstanding a service temperature, the service temperature being greater than a debinding temperature that is less than 1000° C., and less than a sintering temperature that is greater than 1250° C. and the inner insulation layer is formed from a second material different from the first material and the second material can withstand the sintering temperature.

15. The compound debinding and sintering furnace of claim 8 further comprising at least one cooling channel traversing through the outer insulation layer.

16. A compound debinding and sintering furnace with controlled contamination of debinding and sintering parts, comprising:

an outer insulation layer;

an inner insulation layer disposed within the outer insulation layer and having an internal hot face surrounding a work zone;

a sealed housing surrounding the inner insulation layer and composed of a refractory material capable of withstanding a service temperature, the service temperature being greater than a debinding temperature that is less than 1000 C, and less than a sintering temperature that is greater than 1250 C;

an outer heater system configured to heat at least a portion of the sealed housing and externally heat the inner insulation layer (i) in conjunction with an inner heater system, heat the work zone to the debinding temperature and (ii) inhibit condensation of a binder within and upon the inner insulation layer during a debinding process;

wherein the inner heater system is configured to internally heat the inner insulation and contribute a majority of heating to heat the work zone to the sintering temperature during a sintering process;

a housing door operable as an openable and closeable portion of the sealed housing;

an outer door insulation that serves as a portion of the outer insulation layer and an inner door insulation that serves as a portion of the inner insulation layer, wherein the outer door insulation is disposed between the housing door and the inner door insulation;

a high-temperature seal arrangement disposed between the outer door insulation and the inner door insulation and configured for providing gaseous isolation therebetween, and the high temperature seal arrangement includes an inner seal and an outer seal in gaseous communication with a gas channel disposed between the inner seal and outer seal; and a gas feed configured to deliver a sweep gas to the gas channel such that the sweep gas transits through the outer seal to inhibit ingress of gaseous contaminants from the outer seal to the inner seal.

* * * * *